US010540851B2

(12) United States Patent
Nicely et al.

(10) Patent No.: US 10,540,851 B2
(45) Date of Patent: Jan. 21, 2020

(54) GAMING SYSTEM AND METHOD PROVIDING A MULTI-PLAYER BONUS GAME

(71) Applicant: IGT, Las Vegas, NV (US)

(72) Inventors: Mark C. Nicely, Daly City, CA (US); Scott A. Caputo, Santa Clara, CA (US); Bryan D. Wolf, Reno, NV (US); Anthony J. Baerlocher, Henderson, NV (US)

(73) Assignee: IGT, Las Vegas, NV (US)

( * ) Notice: Subject to any disclaimer, the term of this patent is extended or adjusted under 35 U.S.C. 154(b) by 284 days.

(21) Appl. No.: 14/962,840

(22) Filed: Dec. 8, 2015

(65) Prior Publication Data

US 2016/0093170 A1 Mar. 31, 2016

Related U.S. Application Data

(63) Continuation of application No. 12/726,019, filed on Mar. 17, 2010, now Pat. No. 9,214,068.

(51) Int. Cl.
*G07F 17/32* (2006.01)
*G07F 17/34* (2006.01)

(52) U.S. Cl.
CPC ..... *G07F 17/3276* (2013.01); *G07F 17/32* (2013.01); *G07F 17/3239* (2013.01);
(Continued)

(58) Field of Classification Search
CPC ..... G07F 17/32; A63F 9/24
See application file for complete search history.

(56) References Cited

U.S. PATENT DOCUMENTS 5,393,057 A 2/1995 Marnell, II
5,833,537 A 11/1998 Barrie
(Continued)

FOREIGN PATENT DOCUMENTS

EP 0945837 A2 * 9/1999 ..... G07F 17/32
GB 2 395 439 5/2004
(Continued)

OTHER PUBLICATIONS

Bingo Game advertisement written by Casino Data System published in 1998.

(Continued)

*Primary Examiner* — James S. McClellan
(74) *Attorney, Agent, or Firm* — Neal, Gerber & Eisenberg LLP

(57) ABSTRACT

One embodiment provides a gaming system having a plurality of gaming devices. Each of the gaming devices enables a player to make wagers on plays of a primary game. For each gaming device, for each occurrence of a designated accumulation outcome, the player of that gaming device accumulates one or more positions on a bonus game display matrix. When a bonus game trigger occurs, the triggering gaming device is identified. In the bonus game, a plurality of symbols are displayed in the plurality of positions of the bonus game display matrix. The player of the triggering gaming device is provided with any awards associated with any winning symbol combinations formed by the displayed symbols. Additionally, for each assigned position of the bonus game display matrix that displays a symbol which is part of a winning symbol combination, a participation award is provided to the player assigned to that position.

23 Claims, 21 Drawing Sheets

(52) U.S. Cl.
CPC ..... *G07F 17/3244* (2013.01); *G07F 17/3246* (2013.01); *G07F 17/3255* (2013.01); *G07F 17/3267* (2013.01); *G07F 17/34* (2013.01)

(56) References Cited

U.S. PATENT DOCUMENTS

| | | | | |
|---|---|---|---|---|
| 5,911,418 | A | 6/1999 | Adams | |
| 5,961,384 | A | 10/1999 | Robinson | |
| 6,048,271 | A | 4/2000 | Barcelou | |
| 6,135,884 | A | 10/2000 | Hedrick et al. | |
| 6,270,411 | B1 | 8/2001 | Gura et al. | |
| 6,315,660 | B1 | 11/2001 | DeMar et al. | |
| 6,364,314 | B1 | 4/2002 | Canterbury | |
| 6,416,409 | B1 | 7/2002 | Jordan | |
| 6,461,241 | B1 | 10/2002 | Webb et al. | |
| 6,471,210 | B1 | 10/2002 | Goldman et al. | |
| 6,482,089 | B2 | 11/2002 | DeMar et al. | |
| 6,494,785 | B1 | 12/2002 | Gerrard et al. | |
| 6,506,117 | B2 | 1/2003 | DeMar et al. | |
| 6,508,707 | B2 | 1/2003 | DeMar et al. | |
| 6,517,073 | B1 | 2/2003 | Vancura | |
| 6,520,855 | B2 | 2/2003 | DeMar et al. | |
| 6,599,193 | B2 | 7/2003 | Baerlocher et al. | |
| 6,602,136 | B1 | 8/2003 | Baerlocher et al. | |
| 6,645,073 | B2 | 11/2003 | Lemay et al. | |
| 6,645,074 | B2 | 11/2003 | Thomas et al. | |
| 6,659,461 | B2 | 12/2003 | Yoseloff et al. | |
| 6,682,419 | B2 | 1/2004 | Webb et al. | |
| 6,682,420 | B2 | 1/2004 | Webb et al. | |
| 6,685,560 | B1 | 2/2004 | Hughes | |
| 6,726,563 | B1 | 4/2004 | Baerlocher et al. | |
| 6,733,389 | B2 | 5/2004 | Webb et al. | |
| 6,749,502 | B2 | 6/2004 | Baerlocher | |
| 6,758,747 | B2 | 7/2004 | Baerlocher | |
| 6,866,583 | B2 | 3/2005 | Glavich et al. | |
| 6,935,955 | B1 | 8/2005 | Kaminkow et al. | |
| 6,981,917 | B2 | 1/2006 | Webb et al. | |
| 6,988,947 | B2 | 1/2006 | Baerlocher et al. | |
| 7,029,395 | B1 | 4/2006 | Baerlocher | |
| 7,040,983 | B2 | 5/2006 | Dolloff et al. | |
| 7,059,965 | B2 | 6/2006 | Jackson | |
| 7,128,646 | B2 | 10/2006 | Baerlocher et al. | |
| 7,128,647 | B2 | 10/2006 | Muir | |
| 7,137,884 | B2 | 11/2006 | Gilmore | |
| 7,137,886 | B2 | 11/2006 | Locke et al. | |
| 7,169,042 | B2 | 1/2007 | Muir et al. | |
| 7,169,046 | B2 | 1/2007 | Webb et al. | |
| 7,192,347 | B1 | 3/2007 | Marks et al. | |
| 7,195,560 | B2 | 3/2007 | DeMar et al. | |
| 7,223,172 | B2 | 5/2007 | Baerlochet et al. | |
| 7,297,058 | B2 | 11/2007 | Gomez et al. | |
| 7,318,773 | B2 | 1/2008 | Baerlocher | |
| 7,329,179 | B2 | 2/2008 | Baerlocher | |
| 7,361,086 | B2 | 4/2008 | Gazdic et al. | |
| 7,371,171 | B1 | 5/2008 | Englman et al. | |
| 7,393,280 | B2 | 7/2008 | Cannon | |
| 7,419,162 | B2 | 9/2008 | Lancaster et al. | |
| 7,427,236 | B2 | 9/2008 | Kaminkow et al. | |
| 7,500,915 | B2 | 3/2009 | Wolf et al. | |
| 7,588,496 | B2 | 9/2009 | Van Asdale | |
| 7,591,724 | B2 | 9/2009 | Baerlocher | |
| 7,618,316 | B2 | 11/2009 | Cole et al. | |
| 2003/0040358 | A1* | 2/2003 | Rothkranz | G07F 17/3211 463/20 |
| 2003/0236115 | A1 | 12/2003 | Chamberlain | |
| 2004/0171416 | A1 | 9/2004 | Baerlocher et al. | |
| 2005/0054430 | A1 | 3/2005 | Pitman et al. | |
| 2005/0054436 | A1 | 3/2005 | Frizzell et al. | |
| 2005/0064924 | A1 | 3/2005 | Glavich et al. | |
| 2005/0070353 | A1 | 3/2005 | Webb et al. | |
| 2005/0181860 | A1 | 8/2005 | Nguyen et al. | |
| 2005/0187014 | A1* | 8/2005 | Saffari | G07F 17/32 463/27 |
| 2005/0192081 | A1 | 9/2005 | Marks et al. | |
| 2005/0218591 | A1 | 10/2005 | Torigian et al. | |
| 2006/0030387 | A1 | 2/2006 | Jackson | |
| 2006/0040732 | A1 | 2/2006 | Baerlocher et al. | |
| 2006/0121971 | A1 | 6/2006 | Slomiany et al. | |
| 2006/0135238 | A1 | 6/2006 | Lancaster et al. | |
| 2006/0246977 | A1 | 11/2006 | Cannon | |
| 2007/0060292 | A1 | 3/2007 | Peterson | |
| 2007/0060321 | A1 | 3/2007 | Vasquez et al. | |
| 2007/0077990 | A1 | 4/2007 | Cuddy et al. | |
| 2007/0087812 | A1 | 4/2007 | Glavich et al. | |
| 2007/0105619 | A1 | 5/2007 | Kniesteadt et al. | |
| 2007/0105620 | A1 | 5/2007 | Cuddy et al. | |
| 2007/0117610 | A1 | 5/2007 | Webb et al. | |
| 2007/0135193 | A1 | 6/2007 | Nicely | |
| 2007/0155485 | A1 | 7/2007 | Cuddy et al. | |
| 2007/0167208 | A1 | 7/2007 | Acres | |
| 2007/0167217 | A1 | 7/2007 | Kaminkow et al. | |
| 2007/0213119 | A1 | 9/2007 | Baerlocher et al. | |
| 2007/0259706 | A1 | 11/2007 | Anderson et al. | |
| 2007/0293293 | A1 | 12/2007 | Baerlocher et al. | |
| 2008/0009334 | A1 | 1/2008 | Walker et al. | |
| 2008/0020815 | A1 | 1/2008 | Lancaster et al. | |
| 2008/0070674 | A1 | 3/2008 | Lancaster et al. | |
| 2008/0076500 | A1 | 3/2008 | Lancaster et al. | |
| 2008/0076531 | A1 | 3/2008 | Baerlocher et al. | |
| 2008/0076532 | A1 | 3/2008 | Graham et al. | |
| 2008/0076542 | A1 | 3/2008 | Iddings et al. | |
| 2008/0102916 | A1 | 5/2008 | Kovacs et al. | |
| 2008/0108406 | A1 | 5/2008 | Oberberger | |
| 2008/0108425 | A1 | 5/2008 | Oberberger | |
| 2008/0108429 | A1 | 5/2008 | Davis et al. | |
| 2008/0113735 | A1 | 5/2008 | Maya | |
| 2008/0113771 | A1 | 5/2008 | Baerlocher et al. | |
| 2008/0139274 | A1 | 6/2008 | Baerlocher | |
| 2008/0153564 | A1 | 6/2008 | Baerlocher et al. | |
| 2009/0036202 | A1 | 2/2009 | Baerlocher et al. | |
| 2009/0111560 | A1 | 4/2009 | Davis et al. | |
| 2009/0117974 | A1 | 5/2009 | Hornik | |
| 2009/0124366 | A1 | 5/2009 | Aoki et al. | |
| 2009/0124385 | A1 | 5/2009 | Cuddy et al. | |
| 2009/0191942 | A1 | 7/2009 | Bennett | |
| 2009/0247271 | A1* | 10/2009 | Olive | G07F 17/3258 463/20 |
| 2010/0016065 | A1 | 1/2010 | Nicely et al. | |
| 2010/0029363 | A1 | 2/2010 | Hoffman et al. | |
| 2010/0029364 | A1 | 2/2010 | Zielinski | |
| 2010/0124988 | A1 | 5/2010 | Amos et al. | |
| 2011/0300926 | A1* | 12/2011 | Englman | G07F 17/3223 463/25 |

FOREIGN PATENT DOCUMENTS

| | | |
|---|---|---|
| JP | 2003-534889 | 11/2003 |
| JP | 2007-061167 | 3/2007 |
| NL | 1028136 | 8/2005 |
| WO | WO 2007087156 | 8/2007 |

OTHER PUBLICATIONS

Jackpot Bingo game description written by CDS.com printed on Apr. 12, 2001.

Blackjack Bingo game description written by Customized Casino Games Ltd available prior to Nov. 13, 2008.

Bjingo game description written by Customized Casino Games Ltd available prior to Mar. 17, 2010.

Monopoly Here and Now.TM. game description written by Wager Works printed from www.wagerworks.com/our-great-games/games-portfolio/slots.html available Aug. 9, 2007.

Sport of Kings.TM. Community Bonus Game description, written by Multimedia Games, available prior to Mar. 17, 2010 (1 pg.).

Sport of Kings.TM. game description, written by Multimedia Games, available prior to Mar. 17, 2010 (1 pg.).

Slot Car Speedway.TM. game description, written by Multimedia Games, available prior to Mar. 17, 2010 (1 pg.).

Letter from Marvin A. Motsenbocker of Mots Law dated Nov. 22, 2011 regarding Third Party Submission in Published Application Under 37 C.F.R. 1.99 filed for U.S. Appl. No. 12/726,019 (1 page).

(56) References Cited

OTHER PUBLICATIONS

Third Party Submission in Published Application Under 37 C.F.R. 1.99 filed for U.S. Appl. No. 12/726,019 , dated Nov. 22, 2011 (3 pages).

* cited by examiner

FIG. 6A 250 248

| | | | | |
|---|---|---|---|---|
| 13th 230a | 10th 230d | 7th 230g | 4th 230j | (P) 1st 230m |
| 11th 230b | 8th 230e | 5th 230h | 2nd 230k | 14th 230n |
| 9th 230c | 6th 230f | 3rd 230i | 15th 230l | 12th 230o |

FIG. 6B 250 248

| | | | | |
|---|---|---|---|---|
| 5th 230a | 4th 230d | 3rd 230g | 2nd 230j | (P) 1st 230m |
| 10th 230b | 9th 230e | 8th 230h | 7th 230k | 6th 230n |
| 15th 230c | 14th 230f | 13th 230i | 12th 230l | 11th 230o |

FIG. 6C 250 248

| | | | | |
|---|---|---|---|---|
| 13th 230a | 12th 230d | 7th 230g | 6th 230j | (P) 1st 230m |
| 14th 230b | 11th 230e | 8th 230h | 5th 230k | 2nd 230n |
| 15th 230c | 10th 230f | 9th 230i | 4th 230l | 3rd 230o |

GAMING SYSTEM AND METHOD PROVIDING A MULTI-PLAYER BONUS GAME

PRIORITY CLAIM

This application is a continuation application of, claims the benefit of and priority to U.S. patent application Ser. No. 12/726,019, filed on Mar. 17, 2010, the entire contents of which are incorporated by reference herein.

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines which provide players awards in primary or base games are well known. Gaming machines generally require the player to place or make a wager to activate the primary or base game. In many of these gaming machines, the award is based on the player obtaining a winning symbol or symbol combination and based on the amount of the wager (e.g., the higher the wager, the higher the award). Symbols or symbol combinations which are less likely to occur usually provide higher awards.

Secondary or bonus games are also known in gaming machines. The secondary or bonus games usually provide an additional award to the player. Secondary or bonus games usually do not require an additional wager by the player to be activated. Secondary or bonus games are generally activated or triggered upon an occurrence of a designated triggering symbol or triggering symbol combination in the primary or base game. For instance, a bonus symbol occurring on the payline on the third reel of a three reel slot machine may trigger the secondary bonus game. When a secondary or bonus game is triggered, the gaming machines generally indicates this to the player through one or more visual and/or audio output devices, such as the reels, lights, speakers, video screens, etc. Part of the enjoyment and excitement of playing certain gaming machines is the occurrence of the secondary or bonus game (even before the player knows how much the bonus award will be). In other words, obtaining a bonus award is part of the enjoyment and excitement for players.

In certain known gaming devices, upon an occurrence of a triggering event in the primary game, the gaming device provides a free spin mode or sequence, wherein one or more free spins of the reels are provided to a player. The triggering event temporarily halts primary game play and enables the player to enter the free spin mode or sequence. The player plays the free spin mode or sequence, likely receives an award during one or more of the free spins and returns to the primary game.

Some known secondary games include a group gaming aspect, wherein a plurality of players playing at linked gaming machines participate in a group event for determining one or more awards. The players playing at such gaming machines have the opportunity to participate in a shared bonus event, such as a communal bonus game provided to the players upon a triggering condition.

To increase player enjoyment and excitement with gaming devices, it is desirable to provide new and different gaming systems which provide bonus awards to players.

SUMMARY

Various embodiments of the present disclosure provide a gaming system and gaming method having a plurality of gaming devices related or linked by a bonus game with a multi-player participation feature or capability (sometimes referred to herein as the "multi-player bonus game" or the "participation bonus game"). In one embodiment, the gaming system includes a central server or central controller configured to communicate with the plurality of gaming devices, each of the gaming devices having a primary or base game operable upon a wager by a player. In various embodiments, the primary games of the gaming devices may be the same game or different games. In operation, each of the gaming devices of the gaming system enables a player of that gaming device to place a primary game wager on a play of the primary game. Each of the gaming devices displays a primary game outcome for the play of the primary game and provides the player of that gaming device with any awards associated with the primary game outcome. If a designated accumulation event occurs for any of the gaming devices, that gaming device sends a signal to the central controller indicating that the designated accumulation event has occurred, or the central controller determines when the designated accumulation event occurs for any of the gaming devices and sends a signal to that gaming device indicating that the designated accumulation event has occurred for that gaming device. For each gaming device, if the designated accumulation event or condition occurs for that gaming device, the central controller assigns or provides to the player of that gaming device one or more bonus game elements for subsequent use in the multi-player or participation bonus game. In one embodiment, the designated accumulation event or condition occurs in the play of the primary game of the gaming device.

As the players of the gaming devices of the gaming system continue to wager on plays of the primary game, the players may continue to accumulate bonus game elements. It should be appreciated that, in certain embodiments, accumulating bonus game elements during primary game play does not provide players with any awards nor does it impact any awards won based on the primary game outcomes. Rather, the potential value of the multi-player bonus game or the probability of winning participation awards in the multi-player bonus game is increased by any accumulated bonus game elements.

When the multi-player bonus game is triggered, such as upon an occurrence of a suitable bonus game triggering event at any one of the gaming devices, the central controller enables the player playing at the gaming device at which the bonus game triggering event occurred (i.e., the triggering gaming device) to play the multi-player bonus game. In the multi-player bonus game, the central controller causes a display of an outcome for the bonus game. The player of the triggering gaming device has the chance to win one or more bonus awards of a first type based on a first evaluation of the bonus game outcome. Additionally, each player who has accumulated a designated quantity of bonus game elements (such as at least one bonus game element) at the time the multi-player bonus game is triggered has the opportunity to win one or more bonus awards of a second type (i.e., participation awards) based on a second, different evaluation, which includes a comparison of the bonus game outcome and any bonus game elements accumulated by that player.

Thus, the present disclosure provides a multi-player bonus game where each player (including the player at the triggering gaming device) who has accumulated a designated quantity of bonus game elements during primary game play has the chance to win participation awards in the multi-player bonus game, regardless of which gaming device actually triggers the multi-player bonus game.

It should be appreciated that, in various embodiments, only the player at the triggering gaming device is a direct participant in the bonus game (i.e., gets to play the bonus game) and has the chance to win bonus awards based on the first evaluation of the bonus game outcome. However, any player (including the player at the triggering gaming device) who has accumulated the designated quantity of bonus game elements is eligible to win one or more participation awards based on the second, different evaluation of the bonus game outcome. When the bonus game is triggered by a first one of the players of the gaming system, each other player of the gaming system who has the designated quantity of bonus game elements is not a direct participant in the first player's bonus game, but that player can still win participation bonus awards based on the result of the first player's bonus game. These players are, in a sense, indirect participants in the bonus game.

The bonus game of the present disclosure thus has a multi-player participation feature, as described above. However, it is not required that more than one player participate in the bonus game. For example, if a first player triggers the bonus game and none of the other players have earned or accumulated any bonus game elements at that time, the first player will have the opportunity to play the bonus game (as a direct participant) without any other players acting as indirect participants. That is, the first player will have the chance to win bonus awards based on the first evaluation of the bonus game outcome. Also, if the first player has any bonus game elements, the first player will have the chance to win participation awards based on the second, different evaluation. Since none of the other players of the gaming system had any accumulated bonus game elements when the bonus game was triggered by the first player, these players do not have the chance to win participation awards based on the first player's bonus game.

In one embodiment, the multi-player bonus game is displayed on the shared display, as well as on the individual display device of the triggering gaming device. In one embodiment, the multi-player bonus game is not automatically displayed on the individual display devices of the non-triggering gaming devices (unless there is a specific request by a player of a non-triggering gaming device to have the multi-player bonus game displayed by the individual display device of his or her gaming device). Thus, the players playing at the non-triggering gaming devices may continue playing the primary games of their respective gaming devices while the multi-player bonus game is displayed for them to see on the shared display. In this manner, players playing at non-triggering gaming devices who have accumulated the designated number of bonus game elements can see if they win any participation awards in the multi-player bonus game without having to interrupt primary game play at their respective gaming devices.

It is therefore an advantage of the present disclosure to provide a gaming system which provides players with more opportunities to win awards.

Another advantage of the present disclosure is to provide a primary game which enables players to build equity or earning potential in a bonus game based primary game play.

A further advantage of the present disclosure is to provide a gaming system wherein, once a player acquires or builds equity in a bonus game, the player has an interest in continuing to play the primary game until the bonus game is triggered.

A further advantage of the present disclosure is to provide a gaming system wherein, in some embodiments, players do not compete against each other for awards and do not affect each other's winnings.

A further advantage of the present disclosure is to provide a gaming system which provides stronger community play experience and encourages any given player to want other players to succeed.

Additional features and advantages are described herein, and will be apparent from the following Detailed Description and the figures.

BRIEF DESCRIPTION OF THE FIGURES

FIGS. 6A, 6B, and 6C are schematic diagrams illustrating three different ways of performing a shifting operation for the multi-player bonus game of the present disclosure.

DETAILED DESCRIPTION

The present disclosure may be implemented in various configurations for gaming machines, gaming devices, or gaming systems, including but not limited to: (1) a dedicated gaming machine, gaming device, or gaming systems wherein the computerized instructions for controlling any games (which are provided by the gaming machine or gaming device) are provided with the gaming machine or gaming device prior to delivery to a gaming establishment; and (2) a changeable gaming machine, gaming device, or gaming system wherein the computerized instructions for controlling any games (which are provided by the gaming machine or gaming device) are downloadable to the gaming machine or gaming device through a data network after the gaming machine or gaming device is in a gaming establishment. In one embodiment, the computerized instructions for controlling any games are executed by at least one central server, central controller, or remote host. In such a "thin client" embodiment, the central server remotely controls any games (or other suitable interfaces) and the gaming device is utilized to display such games (or suitable interfaces) and receive one or more inputs or commands from a player. In another embodiment, the computerized instructions for controlling any games are communicated from the central server, central controller, or remote host to a gaming device local processor and memory devices. In such a "thick client" embodiment, the gaming device local processor executes the communicated computerized instructions to control any games (or other suitable interfaces) provided to a player.

In one embodiment, one or more gaming devices in a gaming system may be thin client gaming devices and one or more gaming devices in the gaming system may be thick client gaming devices. In another embodiment, certain functions of the gaming device are implemented in a thin client environment and certain other functions of the gaming device are implemented in a thick client environment. In one such embodiment, computerized instructions for controlling any primary games are communicated from the central server to the gaming device in a thick client configuration and computerized instructions for controlling any secondary games or bonus functions are executed by a central server in a thin client configuration.

Figure 1A:
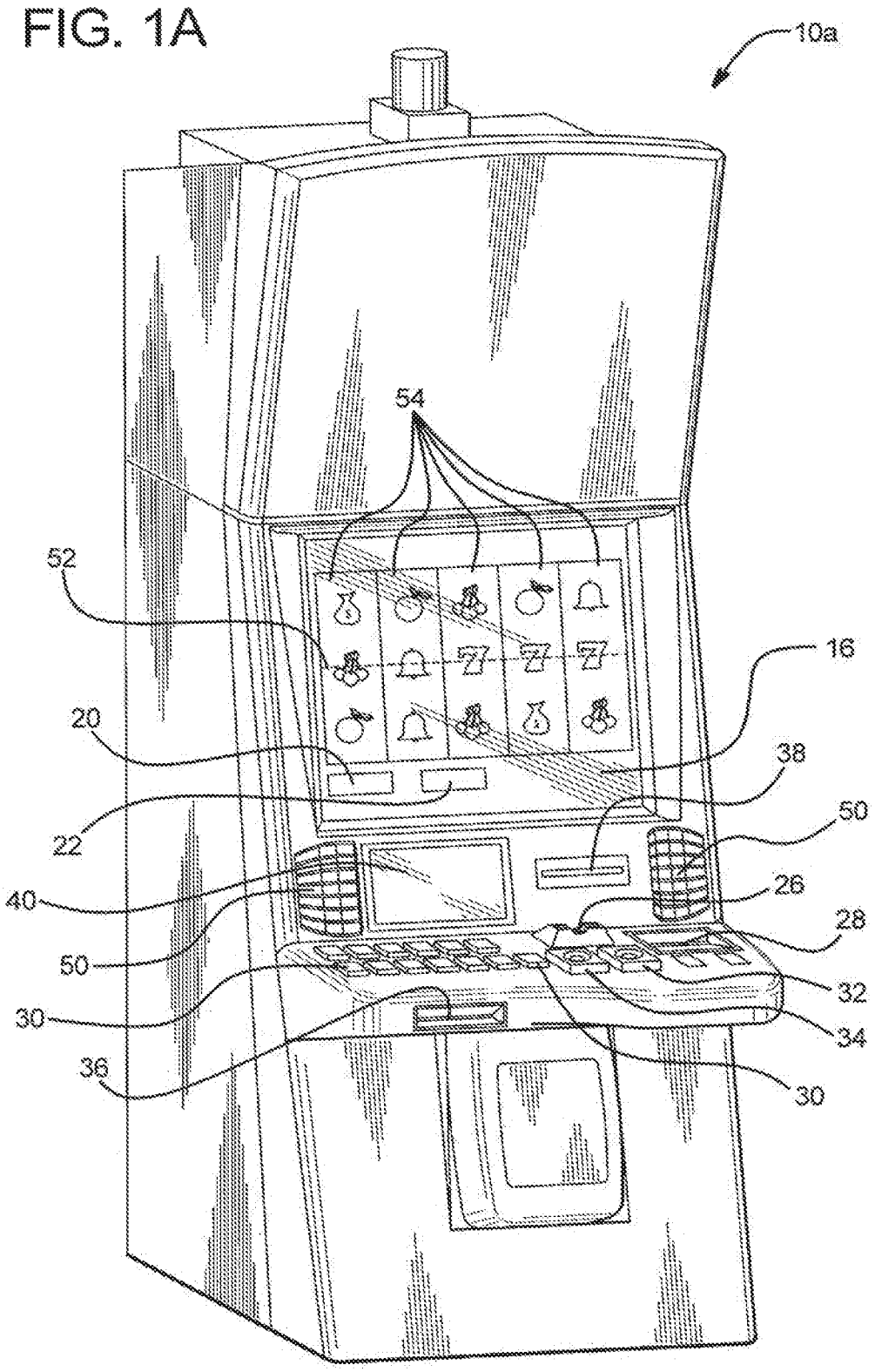
FIG. 1A is a front perspective view of one embodiment of one of the gaming devices of the gaming system of the present disclosure.
Figure 1B:
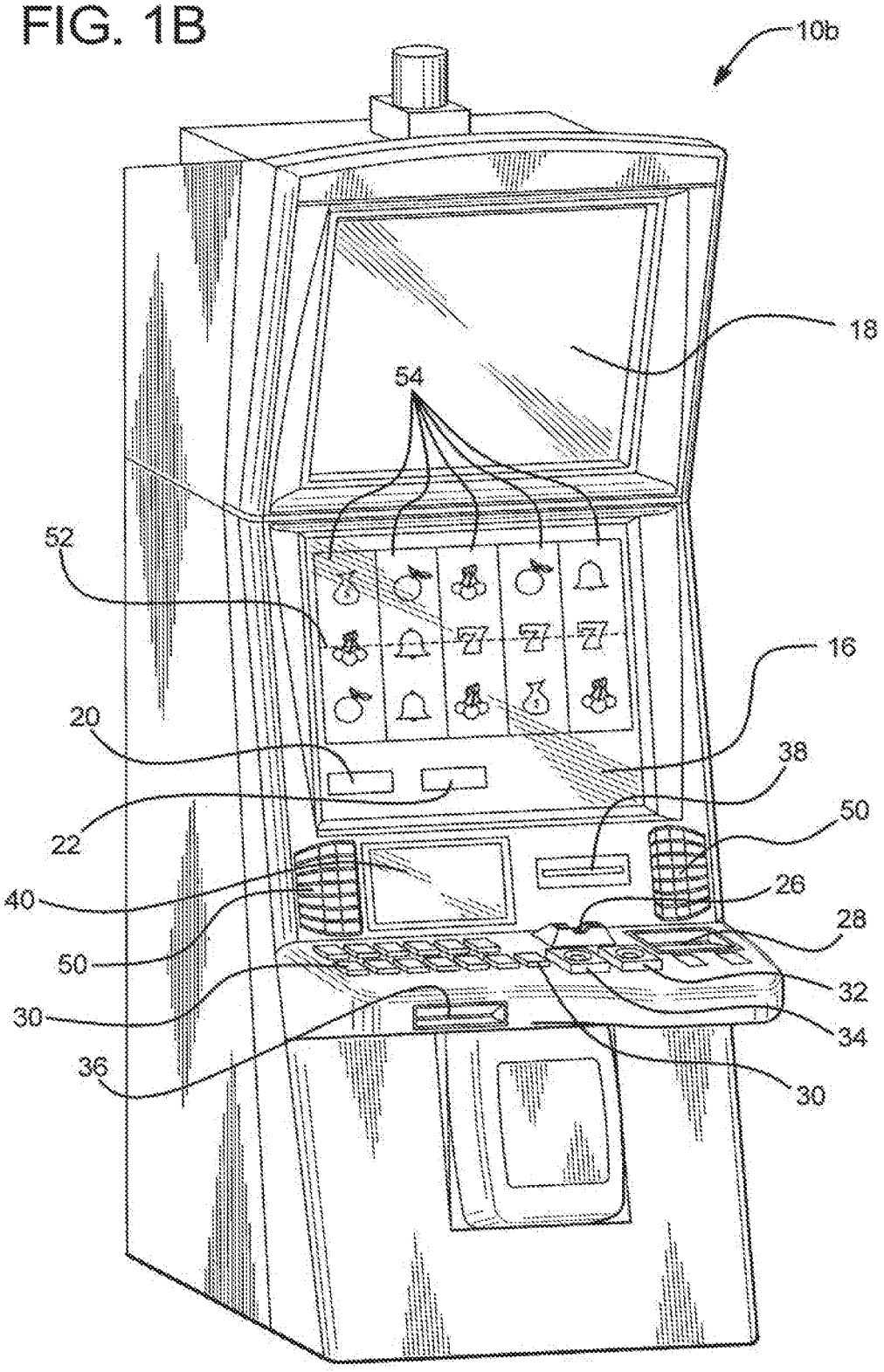
FIG. 1B is a front perspective view of one alternative embodiment of one of the gaming devices of the gaming system of the present disclosure.

Referring now to the drawings, two example alternative embodiments of a gaming device disclosed herein are illustrated in FIGS. 1A and 1B as gaming device 10*a* and gaming device 10*b*, respectively. Gaming device 10*a* and/or gaming device 10*b* are generally referred to herein as gaming device 10.

In the embodiments illustrated in FIGS. 1A and 1B, gaming device 10 has a support structure, housing, or cabinet which provides support for a plurality of displays, inputs, controls, and other features of a conventional gaming machine. It is configured so that a player can operate it while standing or sitting. The gaming device can be positioned on a base or stand or can be configured as a pub-style table-top game (not shown) which a player can operate preferably while sitting. As illustrated by the different configurations shown in FIGS. 1A and 1B, the gaming device may have varying cabinet and display configurations.

Figure 2A:
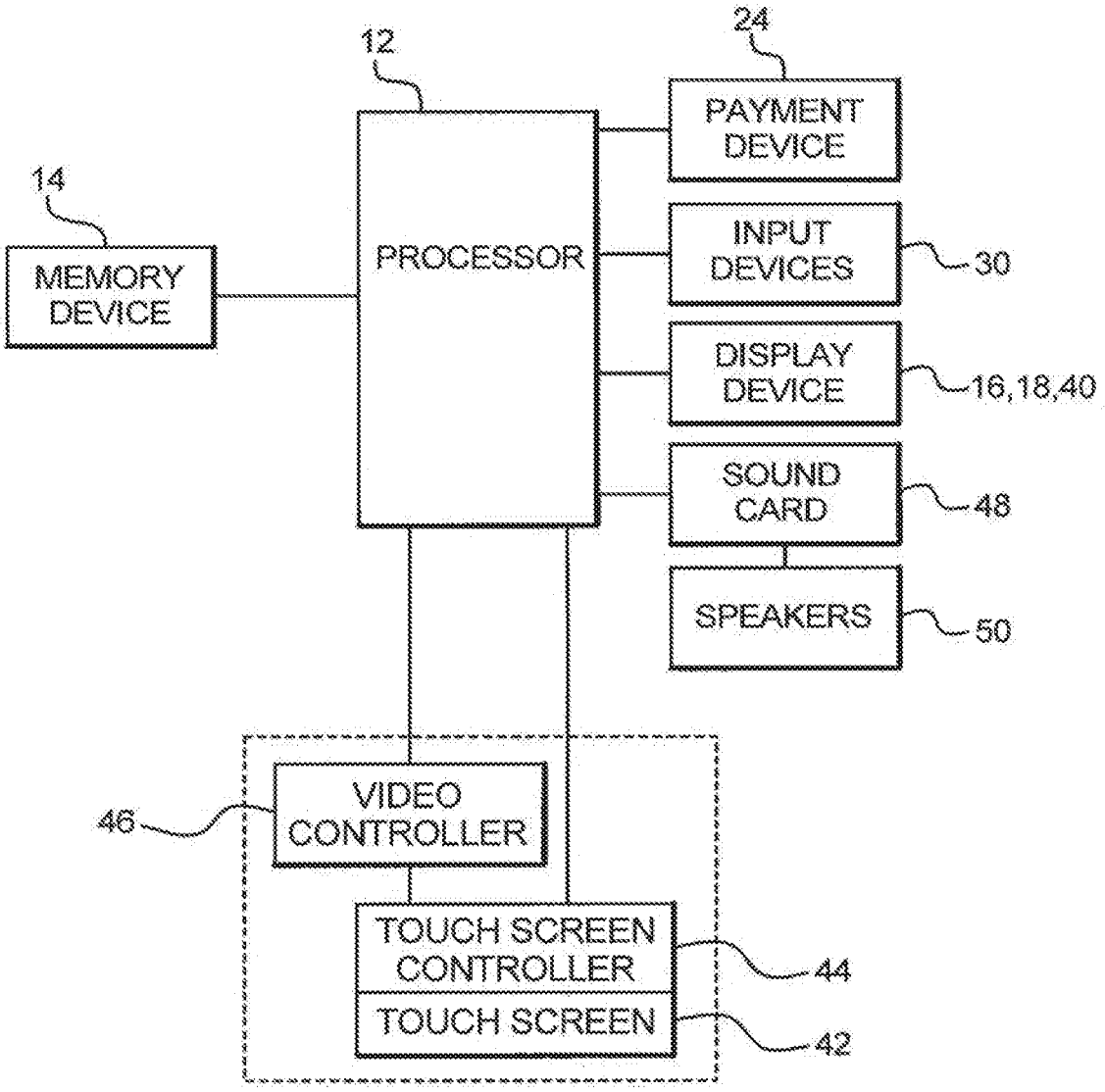
FIG. 2A is a schematic diagram of the electronic configuration of one embodiment of one of the gaming devices of the present disclosure.

In one embodiment, as illustrated in FIG. 2A, the gaming device preferably includes at least one processor 12, such as a microprocessor, a microcontroller-based platform, a suitable integrated circuit or one or more application-specific integrated circuits (ASIC's). The processor is in communication with or operable to access or to exchange signals with at least one data storage or memory device 14. In one embodiment, the processor and the memory device reside within the cabinet of the gaming device. The memory device stores program code and instructions, executable by the processor, to control the gaming device. The memory device also stores other data such as image data, event data, player input data, random or pseudo-random number generators, pay-table data or information, and applicable game rules that relate to the play of the gaming device. In one embodiment, the memory device includes random access memory (RAM), which can include non-volatile RAM (NVRAM), magnetic RAM (MRAM), ferroelectric RAM (FeRAM), and other forms as commonly understood in the gaming industry. In one embodiment, the memory device includes read only memory (ROM). In one embodiment, the memory device includes flash memory and/or EEPROM (electrically erasable programmable read only memory). Any other suitable magnetic, optical, and/or semiconductor memory may operate in conjunction with the gaming device disclosed herein.

In one embodiment, part or all of the program code and/or operating data described above can be stored in a detachable or removable memory device, including, but not limited to, a suitable cartridge, disk, CD ROM, DVD, or USB memory device. In other embodiments, part or all of the program code and/or operating data described above can be downloaded to the memory device through a suitable network.

In one embodiment, an operator or a player can use such a removable memory device in a desktop computer, a laptop computer, a personal digital assistant (PDA), a portable computing device, or another computerized platform to implement the present disclosure. In one embodiment, the gaming device or gaming machine disclosed herein is operable over a wireless network, for example part of a wireless gaming system. In this embodiment, the gaming machine may be a hand-held device, a mobile device, or any other suitable wireless device that enables a player to play any suitable game at a variety of different locations. It should be appreciated that a gaming device or gaming machine as disclosed herein may be a device that has obtained approval from a regulatory gaming commission or a device that has not obtained approval from a regulatory gaming commission. It should be appreciated that the processor and memory device may be collectively referred to herein as a "computer" or "controller."

In one embodiment, as discussed in more detail below, the gaming device randomly generates awards and/or other game outcomes based on probability data. In one such embodiment, this random determination is provided through utilization of a random number generator (RNG), such as a true random number generator, a pseudo random number generator, or other suitable randomization process. In one embodiment, each award or other game outcome is associated with a probability and the gaming device generates the award or other game outcome to be provided to the player based on the associated probabilities. In this embodiment, since the gaming device generates outcomes randomly or based upon one or more probability calculations, there is no certainty that the gaming device will ever provide the player with any specific award or other game outcome.

In another embodiment, as discussed in more detail below, the gaming device employs a predetermined or finite set or pool of awards or other game outcomes. In this embodiment, as each award or other game outcome is provided to the player, the gaming device flags or removes the provided award or other game outcome from the predetermined set or pool. Once flagged or removed from the set or pool, the specific provided award or other game outcome from that specific pool cannot be provided to the player again. This type of gaming device provides players with all of the available awards or other game outcomes over the course of the play cycle and guarantees the amount of actual wins and losses.

In one embodiment, as illustrated in FIG. 2A, the gaming device includes one or more display devices controlled by the processor. The display devices are preferably connected to or mounted on the cabinet of the gaming device. The embodiment shown in FIG. 1A includes a central display device 16 which displays a primary game. This display device may also display any suitable secondary game associated with the primary game as well as information relating to the primary or secondary game. The alternative embodiment shown in FIG. 1B includes a central display device 16 and an upper display device 18. The upper display device may display the primary game, any suitable secondary game associated or not associated with the primary game and/or information relating to the primary or secondary game. These display devices may also serve as digital glass operable to advertise games or other aspects of the gaming establishment. As seen in FIGS. 1A and 1B, in one embodiment, the gaming device includes a credit display 20 which displays a player's current number of credits, cash, account balance, or the equivalent. In one embodiment, the gaming device includes a bet display 22 which displays a player's amount wagered. In one embodiment, as described in more detail below, the gaming device includes a player tracking display 40 which displays information regarding a player's play tracking status.

In another embodiment, at least one display device may be a mobile display device, such as a PDA or tablet PC, that enables play of at least a portion of the primary or secondary game at a location remote from the gaming device.

The display devices may include, without limitation, a monitor, a television display, a plasma display, a liquid crystal display (LCD) a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In one embodiment, as described in more detail below, the display device includes a touch-screen with an associated touch-screen controller. The display devices may be of any suitable size and configuration, such as a square, a rectangle or an elongated rectangle.

The display devices of the gaming device are configured to display at least one and preferably a plurality of game or other suitable images, symbols and indicia such as any visual representation or exhibition of the movement of objects such as mechanical, virtual, or video reels and wheels, dynamic lighting, video images, images of people, characters, places, things, faces of cards, and the like.

In one alternative embodiment, the symbols, images and indicia displayed on or of the display device may be in mechanical form. That is, the display device may include any electromechanical device, such as one or more mechanical objects, such as one or more rotatable wheels, reels, or dice, configured to display at least one or a plurality of game or other suitable images, symbols or indicia.

As illustrated in FIG. 2A, in one embodiment, the gaming device includes at least one payment device 24 in communication with the processor. As seen in FIGS. 1A and 1B, a payment device such as a payment acceptor includes a note, ticket or bill acceptor 28 wherein the player inserts paper money, a ticket, or voucher and a coin slot 26 where the player inserts money, coins, or tokens. In other embodiments, payment devices such as readers or validators for credit cards, debit cards or credit slips may accept payment. In one embodiment, a player may insert an identification card into a card reader of the gaming device. In one embodiment, the identification card is a smart card having a programmed microchip or a magnetic strip coded with a player's identification, credit totals (or related data), and other relevant information. In another embodiment, a player may carry a portable device, such as a cell phone, a radio frequency identification tag, or any other suitable wireless device, which communicates a player's identification, credit totals (or related data), and other relevant information to the gaming device. In one embodiment, money may be transferred to a gaming device through electronic funds transfer. When a player funds the gaming device, the processor determines the amount of funds entered and displays the corresponding amount on the credit or other suitable display as described above.

As seen in FIGS. 1A, 1B, and 2A, in one embodiment the gaming device includes at least one and preferably a plurality of input devices 30 in communication with the processor. The input devices can include any suitable device which enables the player to produce an input signal which is received by the processor. In one embodiment, after appropriate funding of the gaming device, the input device is a game activation device, such as a play button 32 or a pull arm (not shown) which is used by the player to start any primary game or sequence of events in the gaming device. The play button can be any suitable play activator such as a bet one button, a max bet button, or a repeat the bet button. In one embodiment, upon appropriate funding, the gaming device begins the game play automatically. In another embodiment, upon the player engaging one of the play buttons, the gaming device automatically activates game play.

In one embodiment, one input device is a bet one button. The player places a bet by pushing the bet one button. The player can increase the bet by one credit each time the player pushes the bet one button. When the player pushes the bet one button, the number of credits shown in the credit display preferably decreases by one, and the number of credits shown in the bet display preferably increases by one. In another embodiment, one input device is a bet max button (not shown) which enables the player to bet the maximum wager permitted for a game of the gaming device.

In one embodiment, one input device is a cash out button 34. The player may push the cash out button and cash out to receive a cash payment or other suitable form of payment corresponding to the number of remaining credits. In one embodiment, when the player cashes out, a payment device, such as a ticket, payment, or note generator 36 prints or otherwise generates a ticket or credit slip to provide to the player. The player receives the ticket or credit slip and may redeem the value associated with the ticket or credit slip via a cashier (or other suitable redemption system). In another embodiment, when the player cashes out, the player receives the coins or tokens in a coin payout tray. It should be appreciated that any suitable payout mechanisms, such as funding to the player's electronically recordable identification card, may be implemented in accordance with the gaming device disclosed herein.

In one embodiment, as mentioned above and as seen in FIG. 2A, one input device is a touch-screen 42 coupled with a touch-screen controller 44 or some other touch-sensitive display overlay to allow for player interaction with the images on the display. The touch-screen and the touch-screen controller are connected to a video controller 46. A player can make decisions and input signals into the gaming device by touching the touch-screen at the appropriate locations. One such input device is a conventional touch-screen button panel.

The gaming device may further include a plurality of communication ports for enabling communication of the processor with external peripherals, such as external video sources, expansion buses, game or other displays, a SCSI port, or a keypad.

In one embodiment, as seen in FIG. 2A, the gaming device includes a sound generating device controlled by one or more sounds cards 48 which function in conjunction with the processor. In one embodiment, the sound generating device includes at least one and preferably a plurality of speakers 50 or other sound generating hardware and/or software for generating sounds, such as by playing music for the primary and/or secondary game or by playing music for other modes of the gaming device, such as an attract mode. In one embodiment, the gaming device provides dynamic sounds coupled with attractive multimedia images displayed on one or more of the display devices to provide an audio-visual representation or to otherwise display full-motion video with sound to attract players to the gaming device. During idle periods, the gaming device may display a sequence of audio and/or visual attraction messages to attract potential players to the gaming device. The videos may also be customized to provide any appropriate information.

In one embodiment, the gaming machine may include a sensor, such as a camera in communication with the processor (and possibly controlled by the processor), that is selectively positioned to acquire an image of a player actively using the gaming device and/or the surrounding area of the gaming device. In one embodiment, the camera may be configured to selectively acquire still or moving (e.g., video) images and may be configured to acquire the images in an analog, digital, or other suitable format. The display devices may be configured to display the image acquired by the camera as well as to display the visible manifestation of the game in split screen or picture-in-picture fashion. For example, the camera may acquire an image of the player and the processor may incorporate that image into the primary and/or secondary game as a game image, symbol or indicia.

Gaming device 10 can incorporate any suitable wagering game as a primary or base game, with various embodiments of the selection game serving as a secondary or bonus game. The gaming machine or device may include some or all of the features of conventional gaming machines or devices. The primary or base game may comprise any suitable reel-type game, card game, cascading or falling symbol game, number game, or other game of chance susceptible to representation in an electronic or electromechanical form, which in one embodiment produces a random outcome based on probability data at the time of or after placement of a wager. That is, different primary wagering games, such as video poker games, video blackjack games, video keno, video bingo or any other suitable primary or base game may be implemented.

In one embodiment, as illustrated in FIGS. 1A and 1B, a base or primary game may be a slot game with one or more paylines 52, with the disclosed selection game serving as a bonus game. The paylines may be horizontal, vertical, circular, diagonal, angled or any combination thereof. In this embodiment, the gaming device includes at least one and preferably a plurality of reels 54, such as three to five reels 54, in either electromechanical form with mechanical rotating reels or video form with simulated reels and movement thereof. In one embodiment, an electromechanical slot machine includes a plurality of adjacent, rotatable reels which may be combined and operably coupled with an electronic display of any suitable type. In another embodiment, if the reels 54 are in video form, one or more of the display devices, as described above, displays the plurality of simulated video reels 54. Each reel 54 displays a plurality of indicia or symbols, such as bells, hearts, fruits, numbers, letters, bars, or other images which preferably correspond to a theme associated with the gaming device. In another embodiment, one or more of the reels are independent reels or unisymbol reels. In this embodiment, each independent or unisymbol reel generates and displays one symbol to the player. In one embodiment, the gaming device awards prizes after the reels of the primary game stop spinning if specified types and/or configurations of indicia or symbols occur on an active payline or otherwise occur in a winning pattern, occur on the requisite number of adjacent reels and/or occur in a scatter pay arrangement.

In an alternative embodiment, rather than determining any outcome to provide to the player by analyzing the symbols generated on any wagered upon paylines as described above, the gaming device determines any outcome to provide to the player based on the number of associated symbols which are generated in active symbol positions on the requisite number of adjacent reels (i.e., not on paylines passing through any displayed winning symbol combinations). In this embodiment, if a winning symbol combination is generated on the reels, the gaming device provides the player one award for that occurrence of the generated winning symbol combination. For example, if one winning symbol combination is generated on the reels, the gaming device will provide a single award to the player for that winning symbol combination (i.e., not based on the number of paylines that would have passed through that winning symbol combination). It should be appreciated that because a gaming device that enables wagering on ways to win provides the player one award for a single occurrence of a winning symbol combination and a gaming device with paylines may provide the player more than one award for the same occurrence of a single winning symbol combination (i.e., if a plurality of paylines each pass through the same winning symbol combination), it is possible to provide a player at a ways to win gaming device with more ways to win for an equivalent bet or wager on a traditional slot gaming device with paylines.

In one embodiment, the total number of ways to win is determined by multiplying the number of symbols generated in active symbol positions on a first reel by the number of symbols generated in active symbol positions on a second reel by the number of symbols generated in active symbol positions on a third reel and so on for each reel of the gaming device with at least one symbol generated in an active symbol position. For example, a three reel gaming device with three symbols generated in active symbol positions on each reel includes 27 ways to win (i.e., 3 symbols on the first reel×3 symbols on the second reel×3 symbols on the third reel). A four reel gaming device with three symbols generated in active symbol positions on each reel includes 81 ways to win (i.e., 3 symbols on the first reel×3 symbols on the second reel×3 symbols on the third reel×3 symbols on the fourth reel). A five reel gaming device with three symbols generated in active symbol positions on each reel includes 243 ways to win (i.e., 3 symbols on the first reel×3 symbols on the second reel×3 symbols on the third reel×3 symbols on the fourth reel×3 symbols on the fifth reel). It should be appreciated that modifying the number of generated symbols by either modifying the number of reels or modifying the number of symbols generated in active symbol positions by one or more of the reels modifies the number of ways to win.

In another embodiment, the gaming device enables a player to wager on and thus activate symbol positions. In one such embodiment, the symbol positions are on the reels. In this embodiment, if based on the player's wager, a reel is activated, then each of the symbol positions of that reel will be activated and each of the active symbol positions will be part of one or more of the ways to win. In one embodiment, if based on the player's wager, a reel is not activated, then a designated number of default symbol positions, such as a single symbol position of the middle row of the reel, will be activated and the default symbol position(s) will be part of one or more of the ways to win. This type of gaming machine enables a player to wager on one, more than one or all of the reels and the processor of the gaming device uses the number of wagered on reels to determine the active symbol positions and the number of possible ways to win. In alternative embodiments, (1) no symbols are displayed as generated at any of the inactive symbol positions, or (2) any symbols generated at any inactive symbol positions may be displayed to the player but suitably shaded or otherwise designated as inactive.

In one embodiment wherein a player wagers on one or more reels, a player's wager of one credit may activate each of the three symbol positions on a first reel, wherein one default symbol position is activated on each of the remaining four reels. In this example, as described above, the gaming device provides the player three ways to win (i.e., 3 symbols on the first reel×1 symbol on the second reel×1 symbol on the third reel×1 symbol on the fourth reel×1 symbol on the fifth reel). In another example, a player's wager of nine credits may activate each of the three symbol positions on a first reel, each of the three symbol positions on a second reel and each of the three symbol positions on a third reel wherein one default symbol position is activated on each of the remaining two reels. In this example, as described above, the gaming device provides the player twenty-seven ways to win (i.e., 3 symbols on the first reel×3 symbols on the second reel×3 symbols on the third reel×1 symbol on the fourth reel×1 symbol on the fifth reel). In one embodiment, to determine any award(s) to provide to the player based on the generated symbols, the gaming device individually determines if a symbol generated in an active symbol position on a first reel forms part of a winning symbol combination with or is otherwise suitably related to a symbol generated in an active symbol position on a second reel. In this embodiment, the gaming device classifies each pair of symbols which form part of a winning symbol combination (i.e., each pair of related symbols) as a string of related symbols. For example, if active symbol positions include a first cherry symbol generated in the top row of a first reel and a second cherry symbol generated in the bottom row of a second reel, the gaming device classifies the two cherry symbols as a string of related symbols because the two cherry symbols form part of a winning symbol combination.

After determining if any strings of related symbols are formed between the symbols on the first reel and the symbols on the second reel, the gaming device determines if any of the symbols from the next adjacent reel should be added to any of the formed strings of related symbols. In this embodiment, for a first of the classified strings of related symbols, the gaming device determines if any of the symbols generated by the next adjacent reel form part of a winning symbol combination or are otherwise related to the symbols of the first string of related symbols. If the gaming device determines that a symbol generated on the next adjacent reel is related to the symbols of the first string of related symbols, that symbol is subsequently added to the first string of related symbols. For example, if the first string of related symbols is the string of related cherry symbols and a related cherry symbol is generated in the middle row of the third reel, the gaming device adds the related cherry symbol generated on the third reel to the previously classified string of cherry symbols.

On the other hand, if the gaming device determines that no symbols generated on the next adjacent reel are related to the symbols of the first string of related symbols, the gaming device marks or flags such string of related symbols as complete. For example, if the first string of related symbols is the string of related cherry symbols and none of the symbols of the third reel are related to the cherry symbols of the previously classified string of cherry symbols, the gaming device marks or flags the string of two cherry symbols as complete.

After either adding a related symbol to the first string of related symbols or marking the first string of related symbols as complete, the gaming device proceeds as described above for each of the remaining classified strings of related symbols which were previously classified or formed from related symbols on the first and second reels.

After analyzing each of the remaining strings of related symbols, the gaming device determines, for each remaining pending or incomplete string of related symbols, if any of the symbols from the next adjacent reel, if any, should be added to any of the previously classified strings of related symbols. This process continues until either each string of related symbols is complete or there are no more adjacent reels of symbols to analyze. In this embodiment, where there are no more adjacent reels of symbols to analyze, the gaming device marks each of the remaining pending strings of related symbols as complete.

When each of the strings of related symbols is marked complete, the gaming device compares each of the strings of related symbols to an appropriate paytable and provides the player any award associated with each of the completed strings of symbols. It should be appreciated that the player is provided one award, if any, for each string of related symbols generated in active symbol positions (i.e., as opposed to a quantity of awards being based on how many paylines that would have passed through each of the strings of related symbols in active symbol positions).

In one embodiment, in addition to winning credits or other awards in a base or primary game, the gaming device may also give players the opportunity to win credits in a bonus or secondary game or in a bonus or secondary round. The bonus or secondary game enables the player to obtain a prize or payout in addition to the prize or payout, if any, obtained from the base or primary game. In general, a bonus or secondary game produces a significantly higher level of player excitement than the base or primary game because it provides a greater expectation of winning than the base or primary game, and is accompanied with more attractive or unusual features than the base or primary game. In one embodiment, the bonus or secondary game may be any type of suitable game, either similar to or completely different from the base or primary game.

In one embodiment, the triggering event or qualifying condition may be a selected outcome in the primary game or a particular arrangement of one or more indicia on a display device in the primary game, such as the number seven appearing on three adjacent reels along a payline in the primary slot game embodiment seen in FIGS. 1A and 1B. In other embodiments, the triggering event or qualifying condition occurs based on exceeding a certain amount of game play (such as number of games, number of credits, amount of time), or reaching a specified number of points earned during game play.

In another embodiment, the gaming device processor 12 or central server 56 randomly provides the player one or more plays of one or more secondary games. In one such embodiment, the gaming device does not provide any apparent reason to the player for qualifying to play a secondary or bonus game. In this embodiment, qualifying for a bonus game is not triggered by an event in or based specifically on any of the plays of any primary game. That is, the gaming device may simply qualify a player to play a secondary game without any explanation or alternatively with simple explanations. In another embodiment, the gaming device (or central server) qualifies a player for a secondary game at least partially based on a game triggered or symbol triggered event, such as at least partially based on the play of a primary game.

In one embodiment, the gaming device includes a program which will automatically begin a bonus round after the player has achieved a triggering event or qualifying condition in the base or primary game. In another embodiment, after a player has qualified for a bonus game, the player may subsequently enhance his/her bonus game participation through continued play on the base or primary game. Thus, for each bonus qualifying event, such as a bonus symbol, that the player obtains, a given number of bonus game wagering points or credits may be accumulated in a "bonus meter" programmed to accrue the bonus wagering credits or entries toward eventual participation in a bonus game. The occurrence of multiple such bonus qualifying events in the primary game may result in an arithmetic or exponential increase in the number of bonus wagering credits awarded. In one embodiment, the player may redeem extra bonus wagering credits during the bonus game to extend play of the bonus game.

In one embodiment, no separate entry fee or buy-in for a bonus game is needed. That is, a player may not purchase entry into a bonus game; rather they must win or earn entry through play of the primary game, thus encouraging play of the primary game. In another embodiment, qualification of the bonus or secondary game is accomplished through a simple "buy-in" by the player—for example, if the player has been unsuccessful at qualifying through other specified activities. In another embodiment, the player must make a separate side-wager on the bonus game or wager a designated amount in the primary game to qualify for the secondary game. In this embodiment, the secondary game triggering event must occur and the side-wager (or designated primary game wager amount) must have been placed to trigger the secondary game.

Figure 2B:
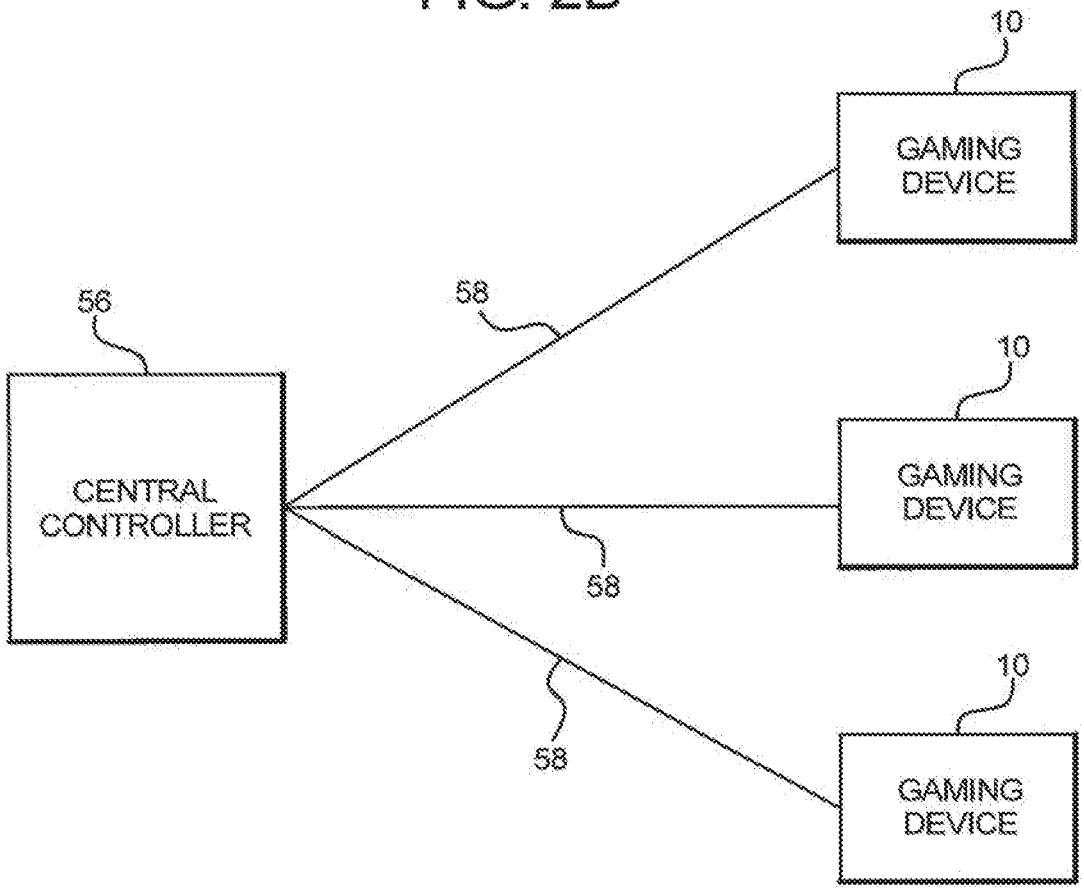
FIG. 2B is a schematic diagram of the central controller in communication with a plurality of gaming machines in accordance with one embodiment disclosed herein.

In one embodiment, as illustrated in FIG. 2B, one or more of the gaming devices 10 are in communication with each other and/or at least one central server, central controller or remote host 56 through a data network or remote communication link 58. In this embodiment, the central server, central controller or remote host is any suitable server or computing device which includes at least one processor and at least one memory or storage device. In different such embodiments, the central server is a progressive controller or a processor of one of the gaming devices in the gaming system. In these embodiments, the processor of each gaming device is designed to transmit and receive events, messages, commands, or any other suitable data or signal between the individual gaming device and the central server. The gaming device processor is operable to execute such communicated events, messages, or commands in conjunction with the operation of the gaming device. Moreover, the processor of the central server is designed to transmit and receive events, messages, commands, or any other suitable data or signal between the central server and each of the individual gaming devices. The central server processor is operable to execute such communicated events, messages, or commands in conjunction with the operation of the central server. It should be appreciated that one, more or each of the functions of the central controller as disclosed herein may be performed by one or more gaming device processors. It should be further appreciated that one, more or each of the functions of one or more gaming device processors as disclosed herein may be performed by the central controller.

In one embodiment, the game outcome provided to the player is determined by a central server or controller and provided to the player at the gaming device. In this embodiment, each of a plurality of such gaming devices is in communication with the central server or controller. Upon a player initiating game play at one of the gaming devices, the initiated gaming device communicates a game outcome request to the central server or controller.

In one embodiment, the central server or controller receives the game outcome request and randomly generates a game outcome for the primary game based on probability data. In another embodiment, the central server or controller randomly generates a game outcome for the secondary game based on probability data. In another embodiment, the central server or controller randomly generates a game outcome for both the primary game and the secondary game based on probability data. In this embodiment, the central server or controller is capable of storing and utilizing program code or other data similar to the processor and memory device of the gaming device.

In an alternative embodiment, the central server or controller maintains one or more predetermined pools or sets of predetermined game outcomes. In this embodiment, the central server or controller receives the game outcome request and independently selects a predetermined game outcome from a set or pool of game outcomes. The central server or controller flags or marks the selected game outcome as used. Once a game outcome is flagged as used, it is prevented from further selection from the set or pool and cannot be selected by the central controller or server upon another wager. The provided game outcome can include a primary game outcome, a secondary game outcome, primary and secondary game outcomes, or a series of game outcomes such as free games.

The central server or controller communicates the generated or selected game outcome to the initiated gaming device. The gaming device receives the generated or selected game outcome and provides the game outcome to the player. In an alternative embodiment, how the generated or selected game outcome is to be presented or displayed to the player, such as a reel symbol combination of a slot machine or a hand of cards dealt in a card game, is also determined by the central server or controller and communicated to the initiated gaming device to be presented or displayed to the player. Central production or control can assist a gaming establishment or other entity in maintaining appropriate records, controlling gaming, reducing and preventing cheating or electronic or other errors, reducing or eliminating win-loss volatility, and the like.

In another embodiment, one or more of the gaming devices are in communication with a central server or controller for monitoring purposes only. That is, each individual gaming device randomly generates the game outcomes to be provided to the player and the central server or controller monitors the activities and events occurring on the plurality of gaming devices. In one embodiment, the gaming network includes a real-time or on-line accounting and gaming information system operably coupled to the central server or controller. The accounting and gaming information system of this embodiment includes a player database for storing player profiles, a player tracking module for tracking players and a credit system for providing automated casino transactions.

In one embodiment, the gaming device disclosed herein is associated with or otherwise integrated with one or more player tracking systems. Player tracking systems enable gaming establishments to recognize the value of customer loyalty through identifying frequent customers and rewarding them for their patronage. In one embodiment, the gaming device and/or player tracking system tracks any player's gaming activity at the gaming device. In one such embodiment, the gaming device includes at least one card reader 38 in communication with the processor. In this embodiment, a player is issued a player identification card which has an encoded player identification number that uniquely identifies the player. When a player inserts their playing tracking card into the card reader to begin a gaming session, the card reader reads the player identification number off the player tracking card to identify the player. The gaming device and/or associated player tracking system timely tracks any suitable information or data relating to the identified player's gaming session. Directly or via the central controller, the gaming device processor communicates such information to the player tracking system. The gaming device and/or associated player tracking system also timely tracks when a player removes their player tracking card when concluding play for that gaming session. In another embodiment, rather than requiring a player to insert a player tracking card, the gaming device utilizes one or more portable devices carried by a player, such as a cell phone, a radio frequency identification tag or any other suitable wireless device to track when a player begins and ends a gaming session. In another embodiment, the gaming device utilizes any suitable biometric technology or ticket technology to track when a player begins and ends a gaming session.

During one or more gaming sessions, the gaming device and/or player tracking system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In one embodiment, such tracked information and/or any suitable feature associated with the player tracking system is displayed on a player tracking display 40. In another embodiment, such tracked information and/or any suitable feature associated with the player tracking system is displayed via one or more service windows (not shown) which are displayed on the central display device and/or the upper display device.

In one embodiment, a plurality of the gaming devices are capable of being connected together through a data network. In one embodiment, the data network is a local area network (LAN), in which one or more of the gaming devices are substantially proximate to each other and an on-site central server or controller as in, for example, a gaming establishment or a portion of a gaming establishment. In another embodiment, the data network is a wide area network (WAN) in which one or more of the gaming devices are in communication with at least one off-site central server or controller. In this embodiment, the plurality of gaming devices may be located in a different part of the gaming establishment or within a different gaming establishment than the off-site central server or controller. Thus, the WAN may include an off-site central server or controller and an off-site gaming device located within gaming establishments in the same geographic area, such as a city or state. The WAN gaming system may be substantially identical to the LAN gaming system described above, although the number of gaming devices in each system may vary relative to one another.

In another embodiment, the data network is an internet or intranet. In this embodiment, the operation of the gaming device can be viewed at the gaming device with at least one internet browser. In this embodiment, operation of the gaming device and accumulation of credits may be accomplished with only a connection to the central server or controller (the internet/intranet server) through a conventional phone or other data transmission line, digital subscriber line (DSL), T-1 line, coaxial cable, fiber optic cable, or other suitable connection. In this embodiment, players may access an internet game page from any location where an internet connection and computer or other internet facilitator is available. The expansion in the number of computers and number and speed of internet connections in recent years increases opportunities for players to play from an ever-increasing number of remote sites. It should be appreciated that the enhanced bandwidth of digital wireless communications may render such technology suitable for some or all communications, particularly if such communications are encrypted. Higher data transmission speeds may be useful for enhancing the sophistication and response of the display and interaction with the player.

As mentioned above, in one embodiment, the present disclosure may be employed in a server-based gaming system. In one such embodiment, as described above, one or more gaming devices are in communication with a central server or controller. The central server or controller may be any suitable server or computing device which includes at least one processor and a memory or storage device. In alternative embodiments, the central server is a progressive controller or another gaming machine in the gaming system. In one embodiment, the memory device of the central server stores different game programs and instructions, executable by a gaming device processor, to control the gaming device. Each executable game program represents a different game or type of game which may be played on one or more of the gaming devices in the gaming system. Such different games may include the same or substantially the same game play with different pay tables. In different embodiments, the executable game program is for a primary game, a secondary game or both. In another embodiment, the game program may be executable as a secondary game to be played simultaneous with the play of a primary game (which may be downloaded to the gaming device) or vice versa.

In this embodiment, each gaming device at least includes one or more display devices and/or one or more input devices for interaction with a player. A local processor, such as the above-described gaming device processor or a processor of a local server, is operable with the display device(s) and/or the input device(s) of one or more of the gaming devices.

In operation, the central controller is operable to communicate one or more of the stored game programs to at least one local processor. In different embodiments, the stored game programs are communicated or delivered by embedding the communicated game program in a device or a component (e.g., a microchip to be inserted in a gaming device), writing the game program on a disc or other media, or downloading or streaming the game program over a dedicated data network, internet, or a telephone line. After the stored game programs are communicated from the central server, the local processor executes the communicated program to facilitate play of the communicated program by a player through the display device(s) and/or input device(s) of the gaming device. That is, when a game program is communicated to a local processor, the local processor changes the game or type of game played at the gaming device.

In another embodiment, a plurality of gaming devices at one or more gaming sites may be networked to the central server in a progressive configuration, as known in the art, wherein a portion of each wager to initiate a base or primary game may be allocated to one or more progressive awards. In one embodiment, a progressive gaming system host site computer is coupled to a plurality of the central servers at a variety of mutually remote gaming sites for providing a multi-site linked progressive automated gaming system. In one embodiment, a progressive gaming system host site computer may serve gaming devices distributed throughout a number of properties at different geographical locations including, for example, different locations within a city or different cities within a state.

In one embodiment, the progressive gaming system host site computer is maintained for the overall operation and control of the progressive gaming system. In this embodiment, a progressive gaming system host site computer oversees the entire progressive gaming system and is the master for computing all progressive jackpots. All participating gaming sites report to, and receive information from, the progressive gaming system host site computer. Each central server computer is responsible for all data communication between the gaming device hardware and software and the progressive gaming system host site computer. In one embodiment, an individual gaming machine may trigger a progressive award win. In another embodiment, a central server (or the progressive gaming system host site computer) determines when a progressive award win is triggered. In another embodiment, an individual gaming machine and a central controller (or progressive gaming system host site computer) work in conjunction with each other to determine when a progressive win is triggered, for example through an individual gaming machine meeting a predetermined requirement established by the central controller.

In one embodiment, a progressive award win is triggered based on one or more game play events, such as a symbol-driven trigger. In other embodiments, the progressive award triggering event or qualifying condition may be achieved by exceeding a certain amount of game play (such as number of games, number of credits, or amount of time), or reaching a specified number of points earned during game play. In another embodiment, a gaming device is randomly or apparently randomly selected to provide a player of that gaming device one or more progressive awards. In one such embodiment, the gaming device does not provide any apparent reasons to the player for winning a progressive award, wherein winning the progressive award is not triggered by an event in or based specifically on any of the plays of any primary game. That is, a player is provided a progressive award without any explanation or alternatively with simple explanations. In another embodiment, a player is provided a progressive award at least partially based on a game triggered or symbol triggered event, such as at least partially based on the play of a primary game.

In one embodiment, one or more of the progressive awards are each funded via a side bet or side wager. In this embodiment, a player must place or wager a side bet to be eligible to win the progressive award associated with the side bet. In one embodiment, the player must place the maximum bet and the side bet to be eligible to win one of the progressive awards. In another embodiment, if the player places or wagers the required side bet, the player may wager at any credit amount during the primary game (i.e., the player need not place the maximum bet and the side bet to be eligible to win one of the progressive awards). In one such embodiment, the greater the player's wager (in addition to the placed side bet), the greater the odds or probability that the player will win one of the progressive awards. It should be appreciated that one or more of the progressive awards may each be funded, at least in part, based on the wagers placed on the primary games of the gaming machines in the gaming system, via a gaming establishment or via any suitable manner.

In another embodiment, one or more of the progressive awards are partially funded via a side-bet or side-wager which the player may make (and which may be tracked via a side-bet meter). In one embodiment, one or more of the progressive awards are funded with only side-bets or side-wagers placed. In another embodiment, one or more of the progressive awards are funded based on player's wagers as described above as well as any side-bets or side-wagers placed.

In one alternative embodiment, a minimum wager level is required for a gaming device to qualify to be selected to obtain one of the progressive awards. In one embodiment, this minimum wager level is the maximum wager level for the primary game in the gaming machine. In another embodiment, no minimum wager level is required for a gaming machine to qualify to be selected to obtain one of the progressive awards.

Bonus Game Having Multi-Player Participation Capability

Figure 3:
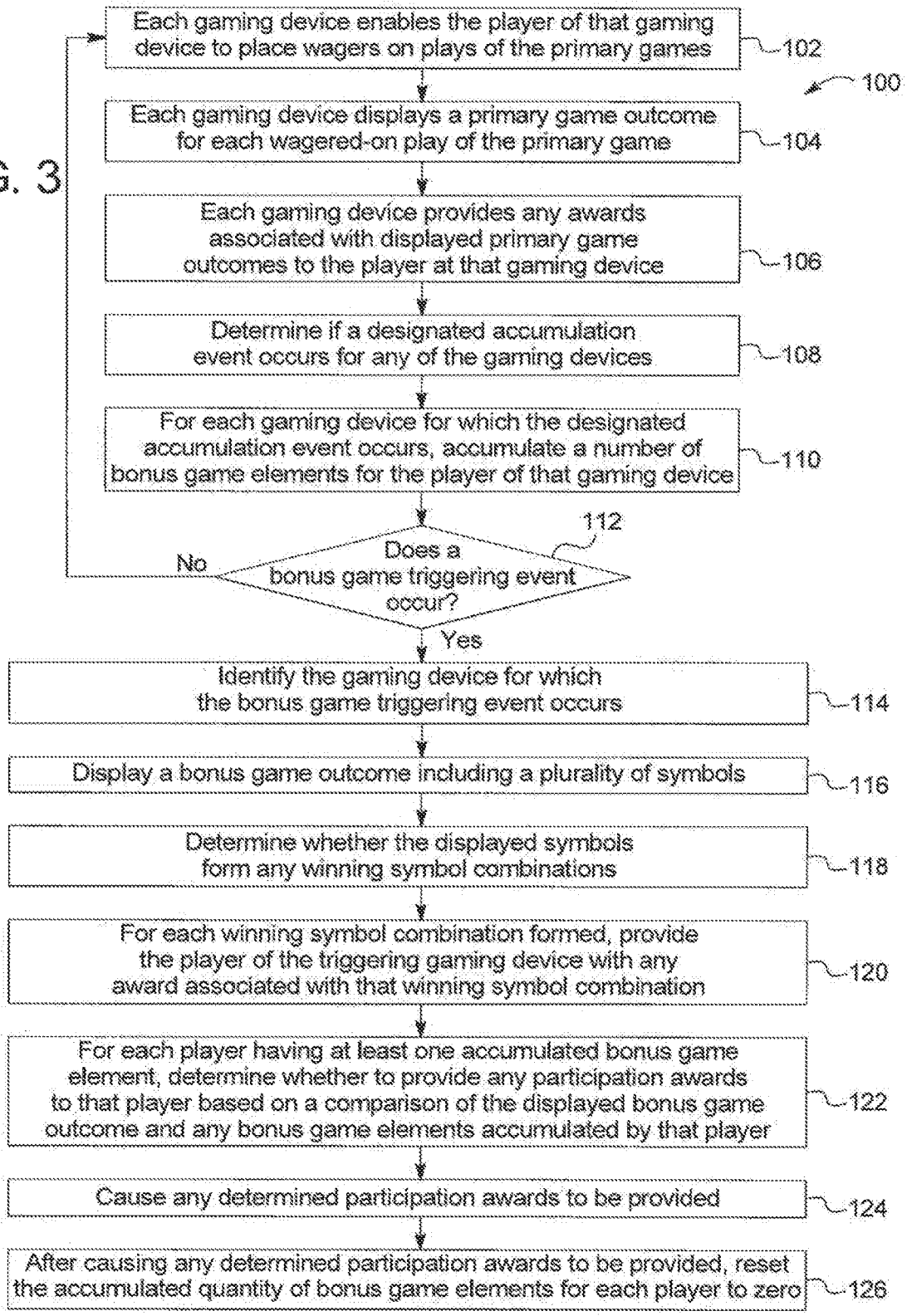
FIG. 3 is a process flow diagram illustrating one example embodiment of the gaming system of the present disclosure.

Referring now to FIG. 3, one embodiment of the present disclosure operates according to sequence 100. In this embodiment, a plurality of players at a plurality of linked gaming devices in a gaming system participate or have the chance to participate in a group gaming environment. In one embodiment, the gaming system includes a central server or controller in communication with or linked to a plurality of gaming devices. Another embodiment of the present disclosure provides a gaming system having a plurality of linked gaming machines where one of the gaming devices functions as the central server or controller.

Each of the gaming devices of the gaming system includes at least one primary or base game operable upon a wager by a player. In some embodiments, each gaming device may have one or a plurality of different primary games. In certain embodiments, the primary games of each gaming device or a plurality of the gaming devices may be the same games or different games. As indicated by block 102, each of the gaming devices enables a player to place primary game wagers on plays of the primary games. For each gaming device, a primary game outcome is generated by a game outcome generating device. It should be appreciated that, in some embodiments, the game outcome generating device is within the gaming device. In other embodiments, the game outcome generating device is within the central server or controller that communicates with the gaming device.

As indicated by block 104, for each gaming device, for each wagered-on play of the primary game at that gaming device, the gaming device displays a primary game outcome to the player of that gaming device. As indicated by block 106, for each gaming device, for each play of the primary game at that gaming device, any awards associated with the primary game outcome are provided to the player of that gaming device.

As indicated by block 108, a determination is made as to whether a designated accumulation event occurs for any of the gaming devices. In various embodiments, the designated accumulation event may include a displayed event in a primary game such as an occurrence of a designated combination of symbols (or sub-symbols) on the reels. In one embodiment, each gaming device determines whether the designated accumulation occurs for that gaming device. When the designated accumulation event occurs for any of the gaming devices, that gaming device sends a signal to the controller indicating that the designated accumulation event has occurred. Alternatively, the central controller determines when the designated accumulation event occurs for any of the gaming devices and sends a signal to that gaming device indicating that the designated accumulation event has occurred for that gaming device.

As indicated by block 110, in this example embodiment, for each gaming device for which the designated accumulation event occurs, the controller accumulates a quantity of bonus game elements for the player of that gaming device for subsequent use in a multi-player or participation bonus game.

It should be appreciated that the act of accumulating bonus game elements does not directly pay the player any awards in this example embodiment. Rather, if the bonus game is triggered, each player who has accumulated a designated quantity of bonus game elements (such as at least one bonus game element) will have an opportunity to win one or more participation awards, regardless of which player triggers the bonus game. In other embodiments, a player may obtain an award for accumulating one or more bonus game elements or may have an option to exchange the element for at least a partial award value.

In one embodiment, for each gaming device, for each occurrence of the designated accumulation event for that gaming device, the player of that gaming device accumulates one bonus game element. In another embodiment, for each occurrence of the designated accumulation event, the player of that gaming device may accumulate any number of bonus game elements, such as two, five, or ten bonus game elements, or any other suitable number of bonus game elements. In other embodiments, multiple occurrences of the designated accumulation event may be required for the player of that gaming device to earn a bonus game element, as discussed below. In one embodiment, different primary games may lead to the accumulation of different quantities of bonus game elements. In one embodiment, different primary games may lead to the accumulation of different types of bonus game elements, such as bonus game elements having different expected values.

As indicated by block 112, a determination is made of whether a bonus game triggering event occurs. In one embodiment, each gaming device determines whether the bonus game triggering event occurs for that gaming device. If the bonus game triggering event occurs for a particular gaming devices, that gaming device sends a signal to the controller indicating that the bonus game triggering event has occurred. Alternatively, the central controller may determine when the bonus game triggering event occurs for any of the gaming devices and sends a signal to that gaming device indicating that the bonus game triggering event has occurred for that gaming device.

In one embodiment, the bonus game triggering event includes a designated outcome in the primary game, such as a particular arrangement of one or more symbols (or sub-symbols) in the primary game. In other embodiments, the triggering event occurs based on exceeding a certain amount of game play (such as number of games, number of credits, amount of time), or reaching a specified number of bonus game elements earned by the players during game play. In another embodiment, the controller randomly causes the bonus game triggering event to occur. In one such embodiment, the controller does not provide any apparent reason to a player for qualifying to play the bonus game. In this embodiment, the bonus game is not triggered by an event based specifically on any of the plays of any primary game. That is, the controller causes the bonus game triggering event to occur without any explanation or alternatively with simple explanations. In another embodiment, the controller causes the bonus game triggering event to occur at least partially based on a game driven or symbol driven event, such as at least partially based on the play of a primary game.

Referring back to FIG. 3, if the determination is that the bonus game triggering event does not occur, each of the gaming devices continues to enable the player of that gaming device to make wagers on plays of the primary game of that gaming device, as indicated by block 102. As the players continue to wager on plays of the primary games of their respective gaming devices, the players can continue to accumulate bonus game elements based on any occurrences of the designated event during primary game play.

As indicated by block 114, if the determination is that the bonus game triggering event occurs for one of the gaming devices, the gaming device for which the triggering event occurred (i.e., the triggering gaming device) is identified. The player of the triggering gaming device will have the opportunity to play the bonus game in an attempt to win bonus awards based on winning symbols or winning combinations of symbols generated during the bonus game. Additionally, each player who has accumulated a designated quantity of accumulated bonus game elements when the bonus game is triggered will have the chance to win participation awards, as discussed below. In this manner, the bonus game has a multi-player participation capability, and, therefore, is sometimes referred to herein as the "multi-player bonus game" or the "participation bonus game."

In one embodiment, each player who has accumulated a designated number of bonus game elements (such as at least one bonus game element) when the multi-player or participation bonus game is triggered will have the chance to win participation awards. In various embodiments, the designated quantity of bonus game elements that a player needs to have to become eligible for participation awards may be predetermined, randomly determined, based on the player's primary game wager, based on time, based on player status, or determined in any other suitable manner.

As indicated by block 116, after the multi-player or participation bonus game is triggered, the controller causes a bonus game outcome including a plurality of symbols to be displayed. As indicated by block 118, the controller performs a first evaluation (or first type of evaluation) of the bonus game outcome to determine whether the symbols form any winning symbol combinations. As indicated by block 120, for each winning symbol combination formed, the controller causes any award associated with that winning symbol combination to be provided to the player of the triggering gaming device.

As indicated by block 122, for each player having the designated number of accumulated bonus game elements, the controller performs a second different evaluation (or second different type of evaluation) to determine whether to provide any participation awards to that player, which includes a comparison of the bonus game outcome and the bonus game elements accumulated by that player. In one embodiment, the controller performs the comparison by determining whether any of the bonus game elements accumulated by that player have a predefined designated relationship to any of the generated symbols of the bonus game outcome. In one embodiment, the controller causes a participation award to be provided to the player for each bonus game element accumulated by that player which has the designated relationship to one of the generated symbols of the bonus game outcome. For example, the gaming system determines whether any of the bonus game elements accumulated by that player match (or are otherwise related to) any of the generated symbols of the bonus game outcome and causes a participation award to be provided the player for each match. In an alternative embodiment, information about which players have accumulated which bonus game elements is sent or transmitted to the triggering gaming device and the triggering gaming device determines whether to provide any participation awards to any of the players.

As indicated by block 124, the controller causes any determined participation awards to be provided to the players. It should be appreciated that, in the example embodiment of FIG. 3, only the player at the triggering gaming device is a direct participant in the multi-player or participation bonus game (i.e., gets to play the multi-player or participation bonus game) and has the chance to win bonus awards based on the first evaluation of the bonus game outcome. That is, only the player at the triggering gaming device can win bonus awards based on any winning symbol combinations generated in the bonus game. However, any player (including the player at the triggering gaming device) who has accumulated the designated quantity of bonus game elements is eligible to win one or more participation awards based on the second, different evaluation.

As indicated by block 126, after the bonus awards and participation awards are provided to the players, the controller resets the accumulated quantity of bonus game elements for each of the players to zero. Each of the players may continue to make wagers on plays of the primary game of his or her respective gaming device and the process repeats itself beginning at block 102. Each of the players can accumulate bonus game elements through further play of the primary game of his or her respective gaming device until the next round of the bonus game is triggered.

As illustrated by the example of FIG. 3, in the multi-player or participation bonus game of the present disclosure, any player who has accumulated the designated quantity of bonus game elements during primary game play has the chance to win awards during the multi-player or participation bonus game, regardless of which gaming device or player actually triggers the multi-player or participation bonus game. When the multi-player or participation bonus game is triggered by a first one of the players of the gaming system, each of the other players of the gaming system who has the designated quantity of bonus game elements is not a direct participant in the first player's bonus game, but these players can still win participation awards based on the result of the first player's bonus game. Players who do not trigger the multi-player or participation bonus game can have some level of participation in the bonus game as indirect participants.

In this manner, the present disclosure provides a bonus game which has a multi-player participation feature or capability. However, it should be appreciated that, it is not required that more than one player participate in the multi-player or participation bonus game.

In one example scenario, a first player triggers the bonus game and none of the players (including the triggering player and any other players of the gaming system) have earned or accumulated any bonus game elements at that time. In this case, the first player will have the opportunity to play the bonus game (as a direct participant) and no players will be indirect participants. That is, the first player will have the chance to win bonus awards based on the first evaluation of the bonus game outcome, and no players will have the chance to win participation awards based on the second evaluation.

In another example scenario, a first player triggers the bonus game and only the first player (i.e., the triggering player) has any accumulated bonus game elements. In this case, the first player will have the opportunity to play the bonus game (as a direct participant) and win bonus awards based on the first evaluation of the bonus game outcome. The first player will also have the chance to win participation awards based on the second evaluation (since the first player has accumulated bonus game elements). None of the other players of the gaming system will be indirect participants in the first player's bonus game.

In another example scenario, a first player triggers the bonus game and the first player (i.e., the triggering player) does not have any accumulated bonus game elements. However, at least one of the other players has accumulated bonus game elements. In this case, the first player will have the opportunity to play the bonus game (as a direct participant) and win bonus awards based on the first evaluation of the bonus game outcome. The first player will not have the chance to win participation awards based on the second evaluation (since the first player has not accumulated any bonus game elements at the time the bonus game is triggered). Additionally, any of the other players who has a designated number of accumulated bonus game elements (such as at least one) will be an indirect participants in the first player's bonus game and, therefore, will have the chance to win participation awards based on the second evaluation.

In a further example scenario, a first player triggers the bonus game, and the first player has accumulated the designated number of bonus game elements. Also, at least one of the other players has accumulated the designated number of bonus game elements. In this case, the first player will have the opportunity to play the bonus game (as a direct participant) and win bonus awards based on the first evaluation of the bonus game outcome. The first player and any of the other players with the designated number of accumulated bonus game elements will have the chance to win participation awards based on the second evaluation.

As described above, players who do not trigger the bonus game can still win participation awards in the bonus game. Thus, there is a rational reason for players to cheer on a fellow player who triggers the bonus game. One player's good fortune does not come at the expense of some other player's loss. When multiple players are participating (either directly or indirectly) in the bonus game, there is no competition between these players.

In one embodiment, the multi-player bonus game is displayed on a shared display for all the players to see, as well as on the individual display device of the triggering gaming device. In one such embodiment, the multi-player bonus game is not automatically displayed to any of the players playing at the non-triggering gaming devices. Thus, the players playing at the non-triggering gaming devices may continue playing the primary games of their respective gaming devices while the multi-player bonus game is displayed for them to see on the shared display. In this manner, players playing at non-triggering gaming devices who have accumulated the designated number of bonus game elements can see if they win any participation awards in the multi-player bonus game without having to interrupt primary game play at their respective gaming devices. In one embodiment, the multi-player bonus game may be displayed to a player of a non-triggering device, if that player specifically requests to have the multi-player bonus game displayed at his or her gaming device. In another embodiment, the multi-player bonus game is displayed on the individual display devices of all the non-triggering devices. In another embodiment, the multi-player bonus game is displayed at each non-triggering device which is associated with one or more bonus game elements (i.e., the player of that gaming device has accumulated one or more bonus game elements).

In certain embodiments, individuals can have their own audio-visual access to the multi-player bonus game display. In some embodiments, such access to the multi-player bonus game display is not contingent upon an individual playing the primary game of one of the linked gaming devices. In some embodiments, this access is provided via a different display device than any of the display devices which display the primary games. In some embodiments, the multi-player bonus game is displayed on two or more community or shared display devices. In some embodiments, the second community or shared display device is of a different type than the first community or shared display device. For example, the second community or shared display device may include an outside billboard or a close-circuit TV channel within the casino.

In one embodiment, each gaming machine is associated with an individual bonus game display for that gaming device. The player of the gaming device may accumulate bonus game elements through primary game play on that gaming device. Any accumulated bonus game elements are tracked, such as by displaying an indication of any accumulated bonus game elements, on the bonus game display for that gaming device. For example, the player may accumulated positions on a bonus game board associated with that gaming device. When the bonus game is triggered, the player will have the chance to play the bonus game to win bonus awards and any participation awards based on any accumulated bonus game elements.

In one embodiment, the gaming system of the present disclosure is implemented over a data network such as the Internet. In one embodiment, the gaming system is implemented over a network and limited to a particular gaming establishment such as a casino. In this embodiment, multiple players can be seated at individual gaming consoles that are stationed at various locations through the casino and all be connected and participating in the same game. In another embodiment, the gaming system is implemented on a network and through a plurality of different gaming establishments. In another embodiment, the gaming system is implemented over a network in one or more gaming establishments and over the Internet. In this embodiment, different players can participate in the same game while separately located at multiple locations and from one or more remote terminals such as a home personal computer connected to the Internet.

Referring now to FIGS. 4A, 4B, 4C, 4D, 4E, 4F, 4G, 4H, 4I, 4J, 4K, 4L, 4M, and 4N one example embodiment of the present disclosure includes a plurality of adjacently arranged gaming devices associated with a shared display. The shared display is configured to display a set of bonus reels associated with a bonus game which has a multi-player participation feature or capability (i.e., the multi-player bonus game). The bonus reels are associated with a plurality of symbol positions arranged in an array or matrix including a plurality of columns and a plurality of rows (i.e., referred to herein as the "bonus game display matrix" or the "bonus game board"). The symbol positions of the bonus game display matrix are separate from the bonus reels, and each position of the bonus game display matrix is configured to display one of the symbols of the bonus reels.

In this example, for each occurrence of a designated position earning event (or accumulation event) at one of the gaming devices, the player of that gaming device earns or accumulates one or more positions on the bonus game display matrix for subsequent use in the bonus game. When the bonus game is triggered, the gaming system enables the player of the triggering gaming device to play the bonus game, which includes a plurality of free activations or free spins of the bonus reels. The player of the triggering gaming (i.e., the player who plays the bonus game) can win awards in each of the free spins based on winning symbol combinations which occur. Additionally, any player who has accumulated at least one position on the bonus game display matrix at the time the bonus game is triggered has the chance to win one or more participation awards, regardless of which gaming device or player causes the multi-player bonus game to be triggered.

Figure 4A:
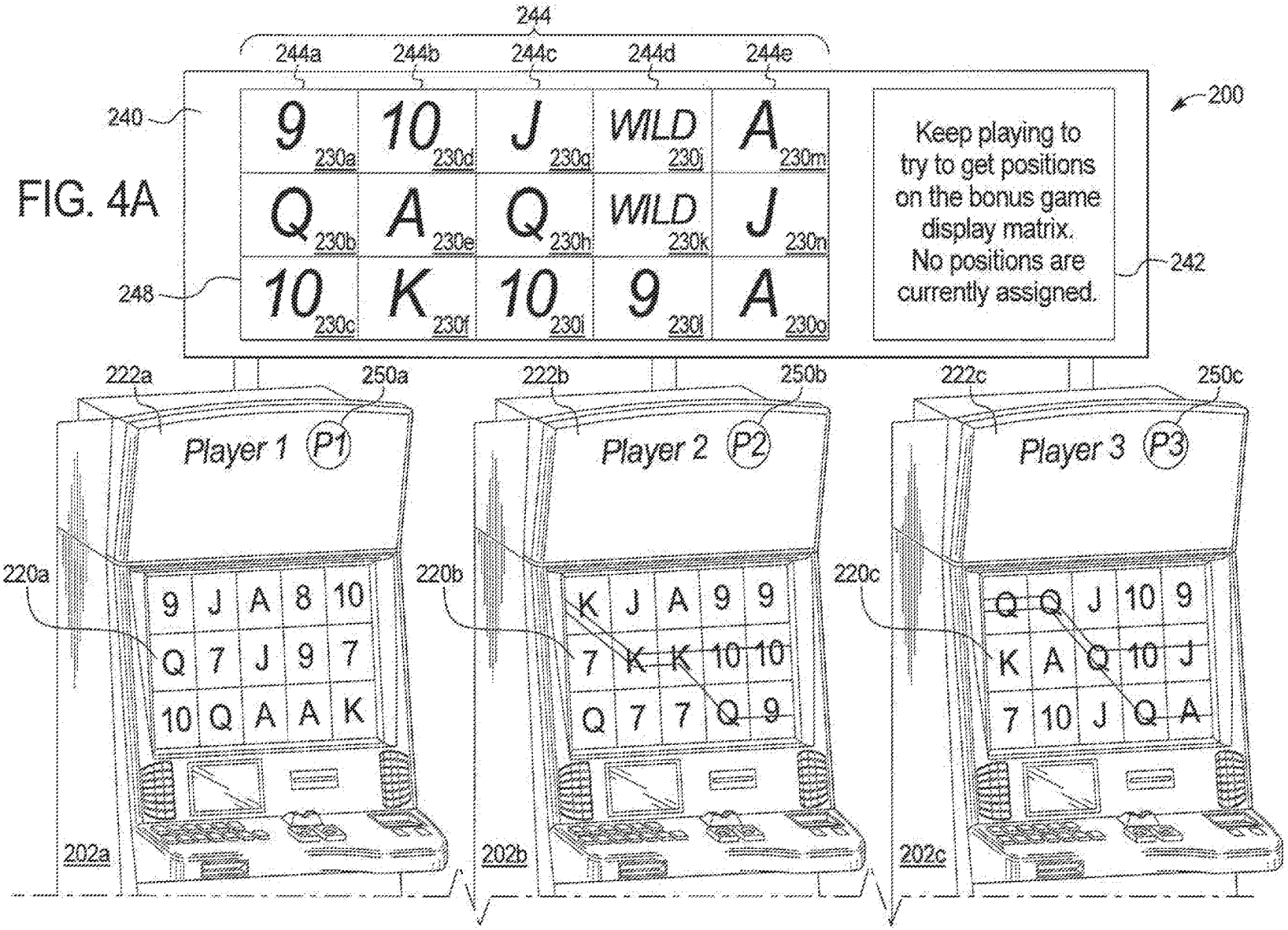
FIGS. 4A, 4B, 4C, 4D, 4E, 4F, 4G, 4H, 4I, 4J, 4K, 4L, 4M, and 4N are perspective views of one example embodiment of the gaming system of the present disclosure including a plurality of gaming devices which enable a plurality of players to each earn positions on a bonus game display matrix for subsequent use in a multi-player bonus game.

As seen in FIG. 4A, the gaming system 200 includes a plurality of gaming devices 202*a*, 202*b*, 202*c* associated with a shared display 240 configured to display the bonus game. More particularly, in the illustrated example, the shared display 240 displays a set of bonus reels 244*a*, 244*b*, 244*c*, 244*d*, and 244*e* (collectively referred to herein as 244) associated with the multi-player bonus game. Each of the bonus reels 244 has a plurality of symbols. The bonus reels 244 are associated with a bonus game display matrix 248 having a plurality of spots or positions 230*a* to 230*o* arranged in a plurality of rows and a plurality of columns. As seen in FIG. 4A, the bonus game display matrix includes fifteen spots or positions 230*a* to 2300, arranged in an array of three rows and five columns. In various embodiments, the bonus game display matrix 248 can incorporate any suitable number of spots or positions arranged in any suitable arrangement of rows and columns. Each of the spots or positions of the bonus game display matrix 248 is configured to display at least one of the symbols of the bonus reels 244. The shared display 240 further includes a message window 242 for providing the players information and instructions relating to the multi-player bonus game.

It should be appreciated that, in FIG. 4A, the positions of the bonus game display matrix 248 show the symbols that were generated from the previous round of the bonus game. When the bonus game is triggered again (as described below), new symbols will be generated and displayed in the positions of the bonus game display matrix 248.

Each of the gaming devices 202*a*, 202*b*, and 202*c* of the gaming system 200 includes a primary display device 220*a*, 220*b*, and 220*c* that displays a primary game. Each of the gaming devices also includes a secondary display device 222*a*, 222*b*, and 222*c*. For ease of illustration, each of the secondary display devices 222*a*, 222*b*, and 222*c* of the gaming devices of this example provides player-specific information about what is occurring during the plays of the primary games and during the multi-player bonus game, such as when a player wins awards and when a player wins positions on the bonus game display matrix 248.

Additionally, each of the secondary display devices 222*a*, 222*b*, and 222*c* of the gaming devices 202*a*, 202*b*, and 202*c* shows a player identifier or marker 250*a*, 250*b*, and 250*c*, which is associated with the player of that gaming device. Player identifier 250*a* is associated with a first player (not shown) who is playing at the first gaming device 202*a*. Player identifier 250*b* is associated with a second player (not shown) who is playing at the second gaming device 202*b*. Player identifier 250*c* is associated with a third player (not shown) who is playing at the third gaming device 202*c*. When a player earns or accumulates a position on the bonus game display matrix 248, the controller assigns a position of the bonus game display matrix 248 to the player and causes the player's identifier or marker to be displayed at that position. In the illustrated embodiment, the player identifiers or markers include circular icons having one of the symbols "P1," "P2," and "P3." It should be appreciated that, in various alternative embodiments, the player identifiers or markers may include any suitable type identifier or marker, including an icon, an avatar, a color, a shape, a number, etc.

At this point in time, the players are just beginning to play the primary games of their respective gaming devices and none of the players have any accumulated positions on the bonus game display matrix 248. Accordingly, there are no player identifiers or markers displayed on the bonus game display matrix 248. The message window 242 of the shared display 240 displays a message prompting the players to play the primary games of their respective gaming machines.

Figure 5:
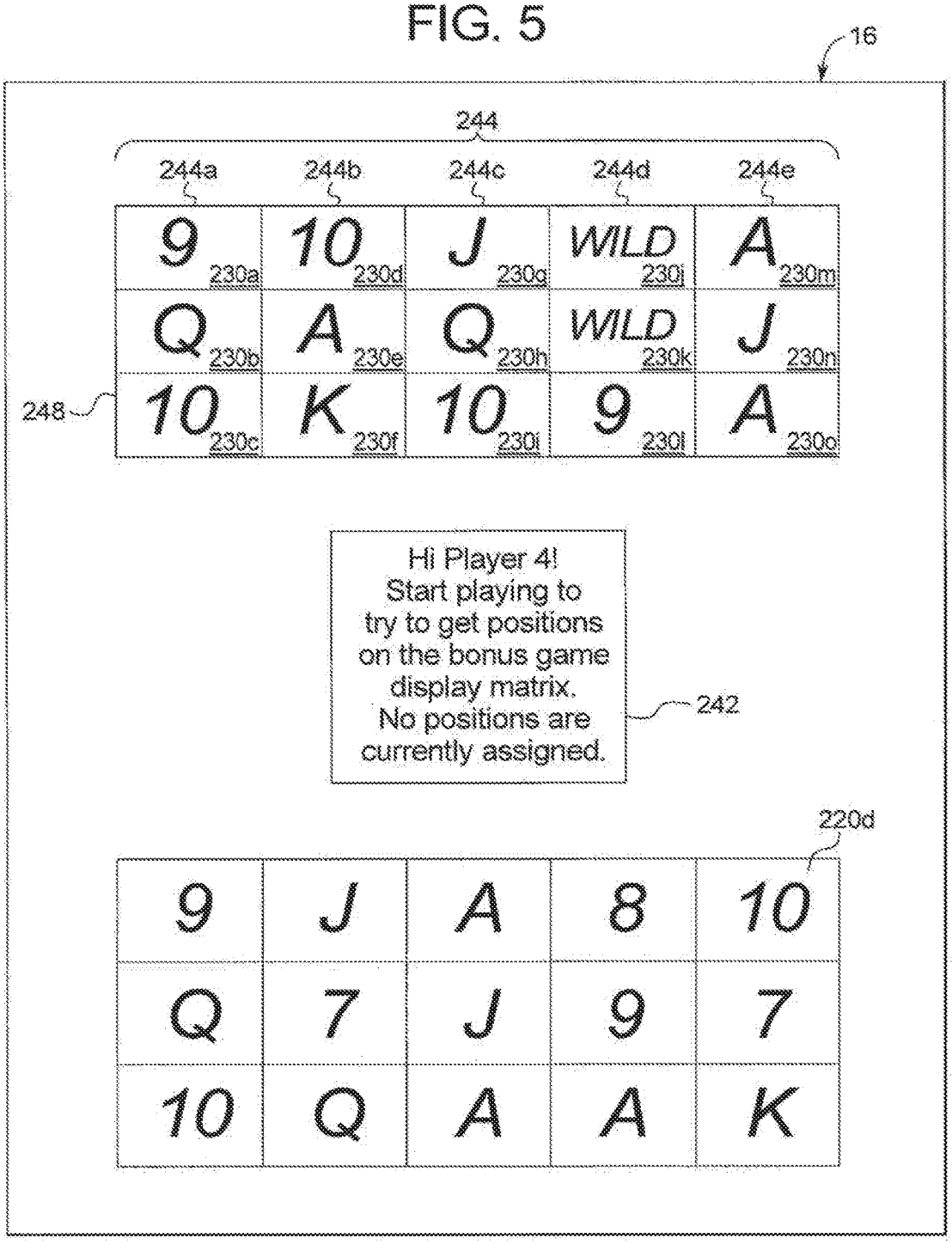
FIG. 5 illustrates a screen shot for one player who is participating in the multi-player bonus game according to one embodiment of the present disclosure.

It should be appreciated that, in certain embodiments, one or more players are not located at the same physical premises (such as via play in an online gaming environment). For instance, FIG. 5 illustrates an example screen shot of for a fourth player who is playing the game through a remote client computer such as a personal computer, and communicates with one or more central servers or controllers through the Internet. As seen in FIG. 5, the display device 16 of the fourth player's computer displays the bonus game display matrix 248 and message window 242 for providing information and instructions relating to the multi-player bonus game. The display device 16 also displays the primary game in a primary game display area 220*d*. The fourth player can see that, at this stage in the game, there are no positions currently assigned to any players. As players begin to accumulate positions of the bonus game display matrix through primary game play, the markers and identifiers will be displayed at various locations of the bonus game display matrix 248. In various embodiments, the system may employ the use of faux players who can earn spots on the bonus game display matrix, particularly during off hours and in online gaming environments.

Figure 4B:
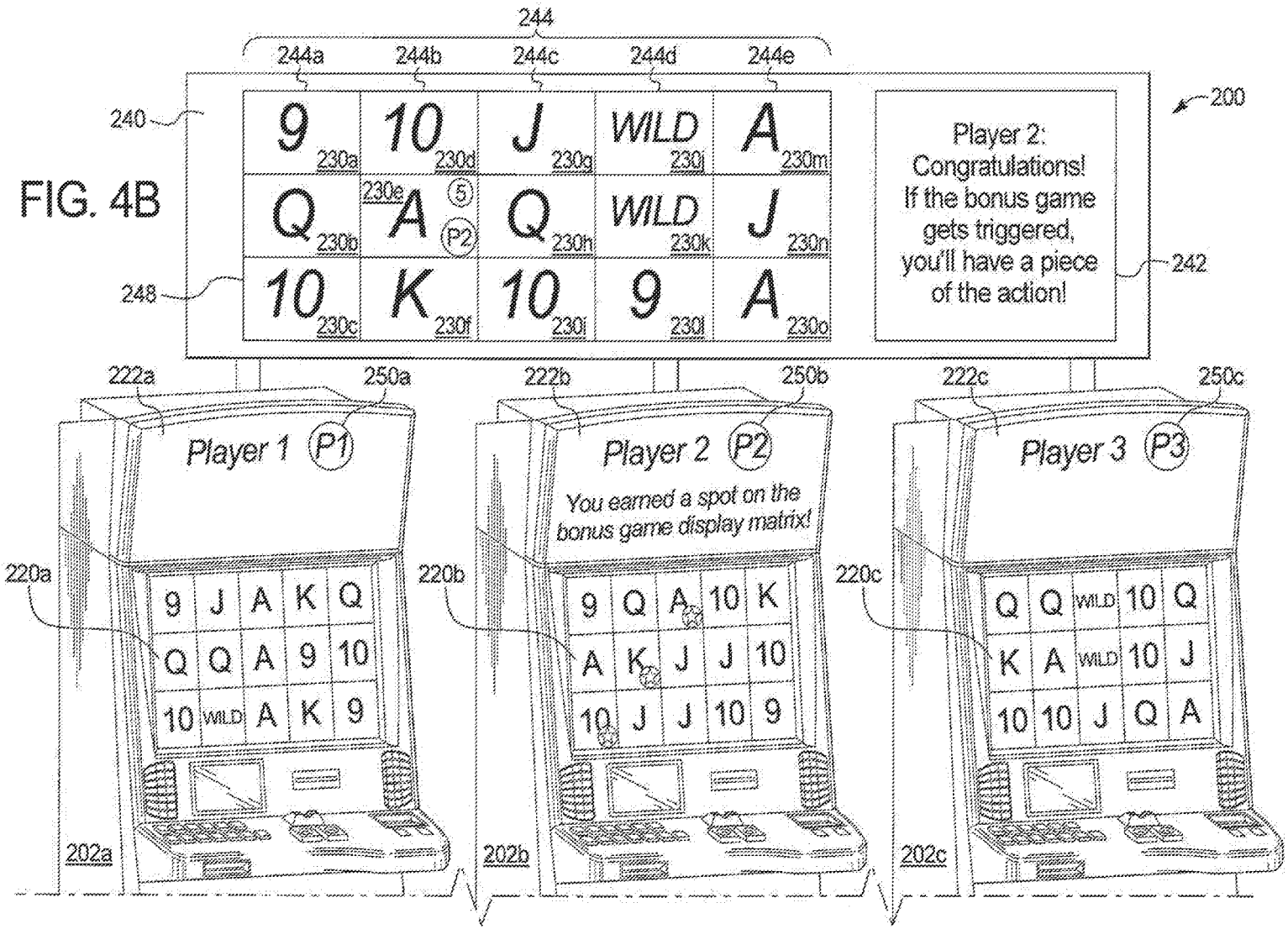

As illustrated in FIG. 4B, the players have started to play the primary games of their gaming devices. As indicated by the primary game display 220*b* of the second gaming device 202*b*, three star sub-symbols are indicated on an active payline. In this example, obtaining three sub-symbols on an active payline is the position earning event. That is, for each occurrence of three sub-symbols on an active payline, a player earns one position on the bonus game display matrix.

In various alternative embodiments, the position earning event may be based on an outcome or event in a primary game including: (a) a winning outcome in the primary game; (b) a losing outcome in the primary game; (c) the occurrence of a designated number of symbols (or sub-symbols) in the primary game appearing anywhere on the reels (i.e. a scatter event); (d) the occurrence of a designated number of symbols (or sub-symbols) aligned along an active payline in the primary game; (e) the occurrence of a designated number of consecutive wins; (f) the occurrence of a designated number of consecutive losses; (g) the occurrence of a designated number of tumbles in a tumbling reels-type game, and (h) any other suitable primary game outcome or event.

In FIG. 4B, since the position earning event occurred at the second gaming device 202*b* (i.e., three star sub-symbols were generated on an active payline in the play of the primary game), the second player has earned one position on the bonus game display matrix 248. The secondary display device 222*b* of the second gaming device 202*b* displays a message congratulating the second player for earning a position on the bonus game display matrix 248 and informing the second player that, if the multi-player bonus game is triggered, he will have a "piece of the action." In other words, even if the second player is not the player who triggers the multi-player bonus game, the second player will have the chance to win participation awards during the multi-player bonus game of another player.

Accordingly, the controller randomly chooses one of the available positions 230*a* to 230*o* of the bonus game display matrix to assign to the second player. As illustrated in FIG. 4B, the controller randomly assigns position 230*e* of the bonus game display matrix 248 to the second player. The controller causes the second player's identifier 250*b* to be displayed at position 230*e* of the bonus game display matrix 248.

In one embodiment, participation awards are based at least in part on the value of a player's primary game wager. Each time a player accumulates a position on the bonus game display matrix, the amount of the primary game wager for that play of the primary game is displayed in association with that position. For example, if the player accumulates a first position on the bonus game display matrix as a result of a play of the primary game on which the player placed a wager of one credit, then the player identifier displayed in that first position would show "one credit," and any participation awards for that position would be multiplied by one. If the player accumulates a second position on the bonus game display matrix as a result of a play of the primary game on which the player placed a wager of five credits, the player identifier displayed in that second position would show "five credits," and any participation awards for that position would be multiplied by five. In other embodiments, the wagers may be represented as bet multipliers which are displayed in association with the player identifiers. For example, wagers of one and five credits are represented as bet multipliers of 1× and 5×, respectively, which are displayed in association with the player identifiers.

As seen in FIG. 4B, the controller causes an indication of the second player's primary game wager to be displayed at position 230*e*. In this example, the second player wagered five credits on the play of the primary game in which the position earning event occurred. Accordingly, the controller causes the number "5" to be displayed next to the second player's identifier or marker 250*b* in the assigned position 230*e* to reflect the player's primary game wager of five credits. In other embodiments, the amount of the primary game wager could be recorded directly on the player's marker or indicated any other suitable position or manner on or in association with the assigned position.

It should be appreciated that, in the illustrated example, each of the three players of the gaming system is making wagers, which are tracked in credits. In various alternative embodiments, the wagers at each of the gaming devices may be tracked (at displayed at any assigned positions) in any suitable manner, such as a number of credits (i.e., if all of the system gaming machines are of the same denomination), as monetary units (e.g., total dollars or other currency) wagered, or as a percentage of the amounts wagered. Tracking in monetary units accounts for gaming machines having multi-denominations and/or for gaming machines of different denominations and/or gaming machines which accept different currencies.

In some embodiments, both cash players and non-cash players can participate in the same multi-player bonus game. In one example, a non-cash player has a number of points, such as two hundred points, that may be used to make wagers on the primary game. This non-cash player may win position of the bonus game display matrix through playing the primary game using the provided points. A bonus game triggered by the non-cash player plays just like a bonus game triggered by a cash player. Any player of a non-triggering gaming device who has accumulated positions on the bonus game display matrix has the chance to win participation awards based on the triggering player's bonus game regardless of the type of wager or the size of the wager made by the triggering player.

Figure 4C:
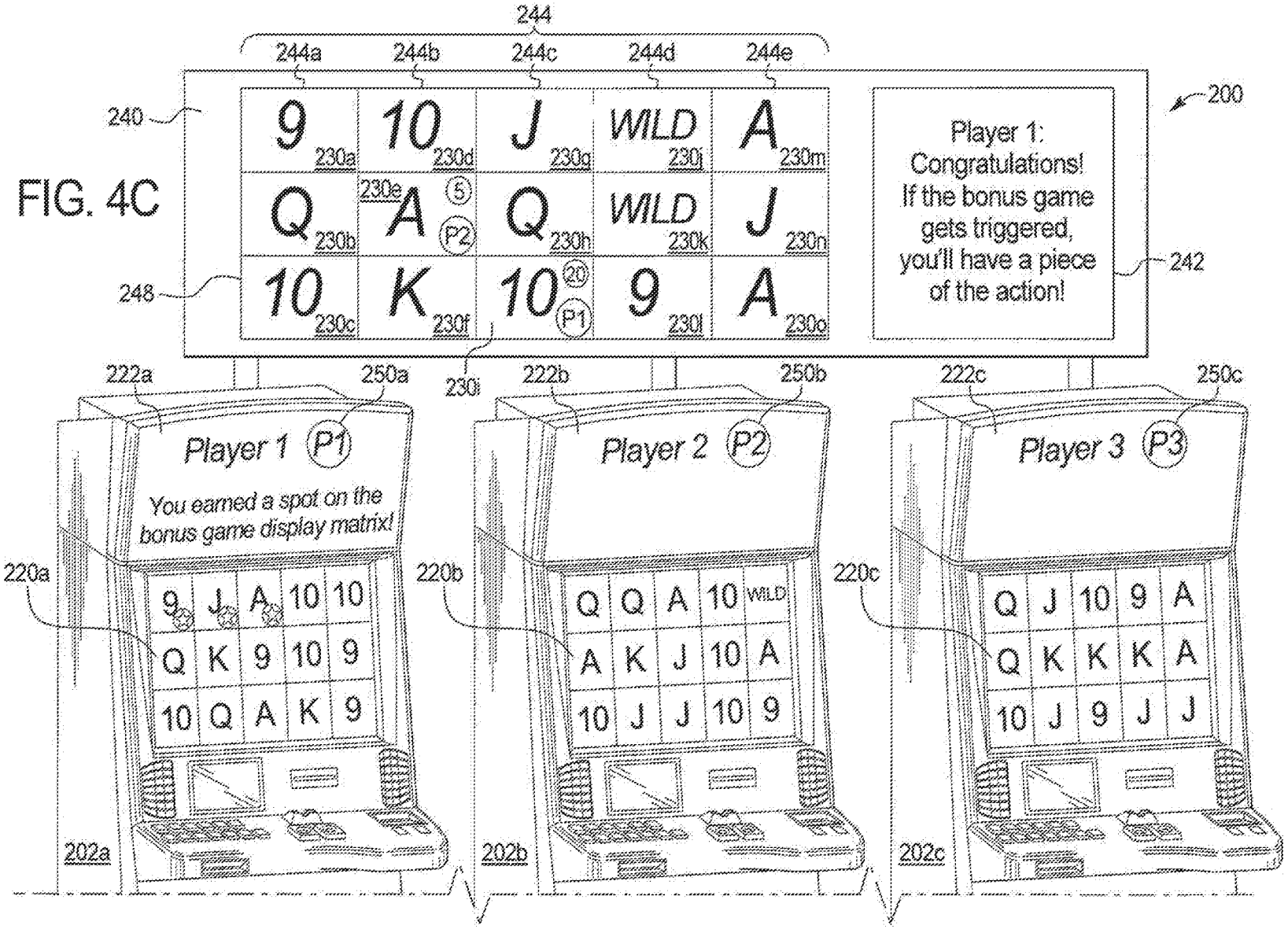

As seen in FIG. 4C, the players continue to play the primary games of their respective gaming devices. As indicated by the primary game display 220*a* of the first gaming device 202*a*, three star sub-symbols are indicated on an active payline. Thus, the position earning event has occurred at the first gaming device 202*a*, and the first player earns a position on the bonus game display matrix 248. Accordingly, the controller randomly assigns one of the available positions of the bonus game display matrix 248 to the first player. More specifically, as seen in FIG. 4C, the controller randomly assigns position 230*i* of the bonus game display matrix 248 to the first player. The controller causes the first player's identifier 250*a* to be displayed at position 230*i* of the bonus game display matrix 248. Additionally, the controller causes an indication of the first player's primary game wager to be displayed at position 230*i*. In this example, the first player wagered twenty credits on the play of the primary game in which the position earning event occurred. Accordingly, the number "20" is displayed next to the first player's marker 250*a* in the assigned position 230*i* to reflect the player's primary game wager of twenty credits. The secondary display device 222*a* of the first gaming device 202*a* displays a message congratulating the first player for earning a position on the bonus game display matrix 248 and informing the first player that, if the multi-player bonus game is triggered, he will also have a piece of the action in the multi-player bonus game.

Figure 4D:
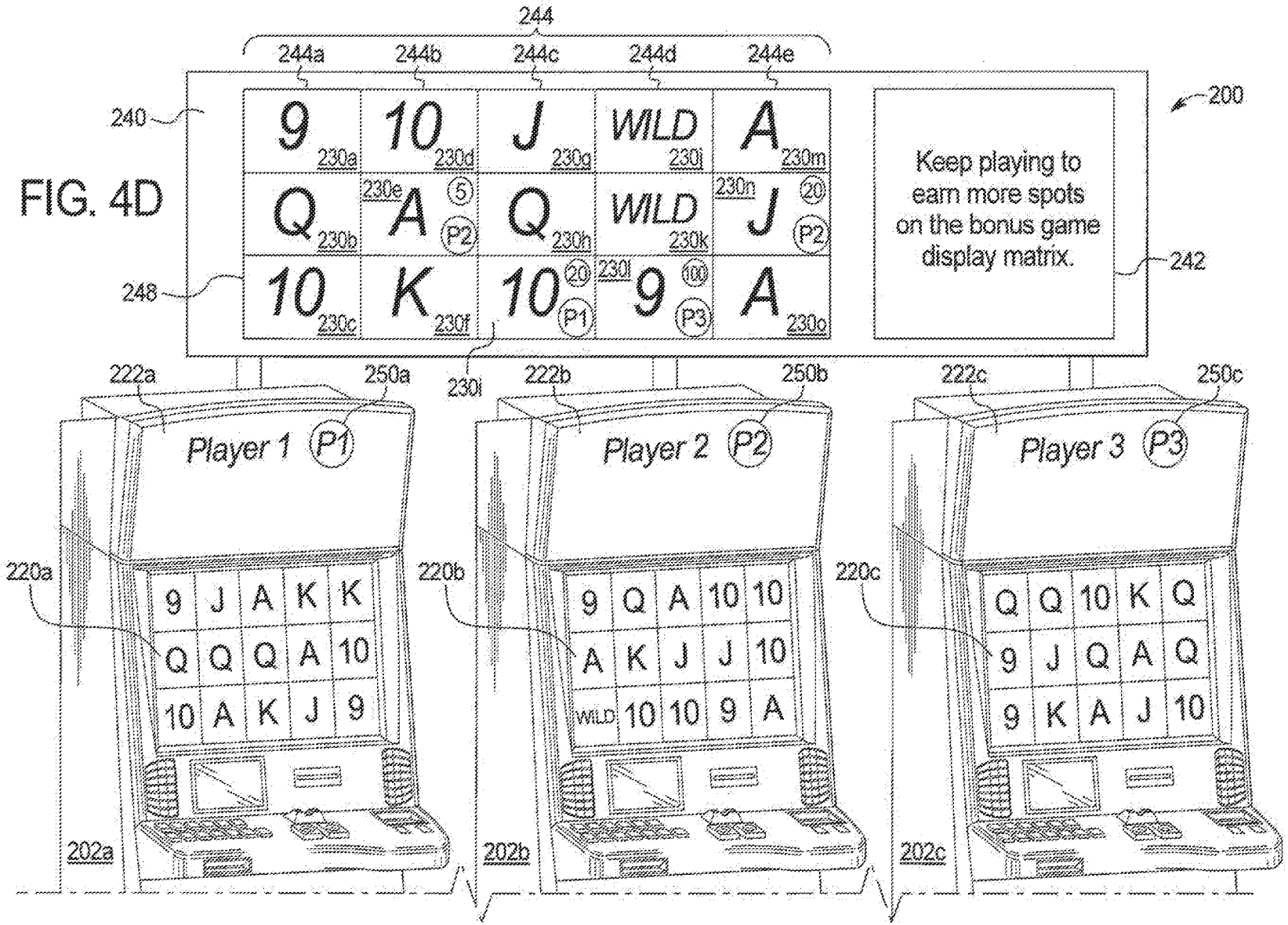

Skipping ahead to a later point in time, as illustrated in FIG. 4D, four positions of the bonus game display matrix 248 have now been assigned to various players. More particularly, the first player has one position (i.e., position 230*i*); the second player has two positions (i.e., positions 230*e* and 230*n*); and the third player has one position (i.e., position 230*l*). The second player managed to accumulate another position on the bonus game display matrix 248. Also, the second player earned this position while playing at higher stakes. The second position assigned to the second player (i.e., position 230*n*) displays the player's identifier or marker 250*b* and the number "20" to reflect the amount wagered by the second player on the play of the primary game in which that position was earned. The third player's position (i.e., position 230*l*) displays the player's identifier or marker 250*c* and the number "100" to reflect the third player's primary game wager of one hundred credits.

At this stage, the multi-player bonus game has not been triggered and message window 242 of the shared display 240 displays a message instructing the players to keep playing the primary games to earn more positions on the bonus game display matrix 248.

Figure 4E:
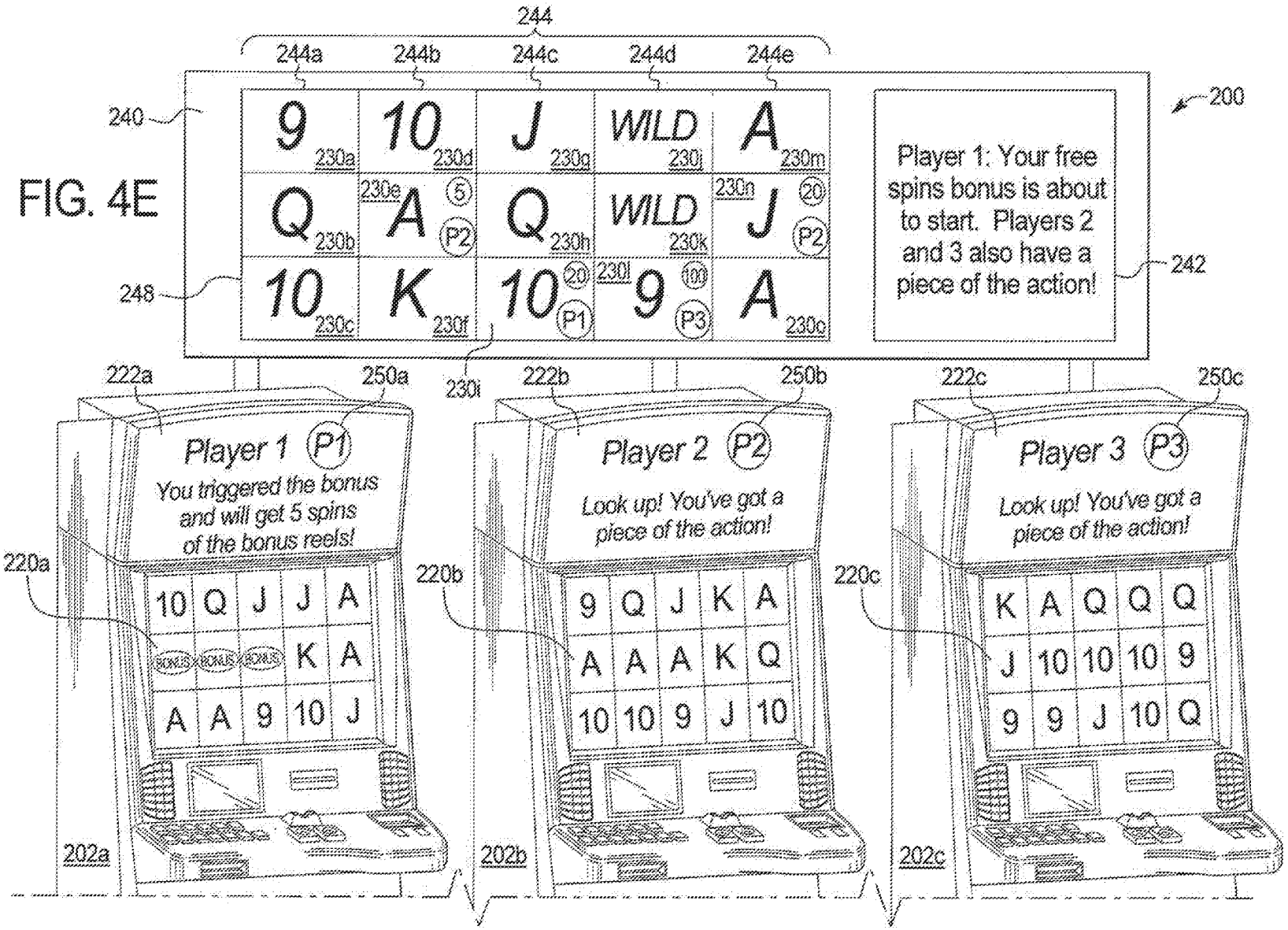

In FIG. 4E, as indicated by the primary display device 220*a* of the first gaming device 202*a*, three "BONUS" symbols are indicated on an active payline. This is the bonus game triggering event. Accordingly, the multi-player bonus game has been triggered.

In the illustrated example, the multi-player bonus game includes five free spins or free activations of the bonus reels 244. In various embodiments, the number of free spins or activations provided in the multi-player bonus game may be predetermined, randomly determined, based on wager level, based on player tracking, determined based on the triggering event that triggered the multi-player bonus game, or determined in any other suitable manner.

As illustrated in FIG. 4E, the secondary display device 222*a* of the first gaming device displays a message to the first player informing him that he will have five free spins of the bonus reels in the multi-player bonus game. In the multi-player bonus game, for each of the five free activations, the controller performs a first evaluation of the displayed symbols to determine whether any winning symbol combinations are formed along any paylines. The central controller causes a bonus award to be provided to the player of the triggering gaming device for each winning symbol combination formed by the displayed symbols. Additionally, the controller performs a second different evaluation to determine whether to provide any participation awards to any of the players who have accumulated at least one position of the bonus game display matrix, as discussed below.

In FIG. 4E, the first player (i.e., the player of the triggering gaming device) will have the opportunity to win awards based on any winning symbol combinations generated in each of the five free activations. Such awards are modified by the amount of the player's primary game wager. In this example, the player wagered twenty credits on the play of the primary game in which the bonus game triggering event occurred. It should be appreciated that, since the first player has a position (i.e., position 230*i*) on the bonus game display matrix 248, he will also have the opportunity to win participation awards in the multi-player bonus game.

The secondary display device 222*b* of the second gaming device 202*b* displays a message instructing the second player to look up at the shared display 240 where the multi-player bonus game will soon be displayed. Although the second player did not trigger the multi-player bonus game, the second player has two positions (i.e., positions 230*e* and 230*n*) on the bonus game display matrix 248, and therefore, the second player has the chance to win one or more participation awards during the multi-player bonus game. Similarly, the secondary display device 222*c* of the third gaming device 202*c* displays a message instructing the third player to look up at the shared display 240. The third player also did not trigger the multi-player bonus game. However, the third player has one position (i.e., position 230*l*) on the bonus game display matrix 248, and therefore, the third player also has a chance to win one or more participation awards during the multi-player bonus game.

Figure 4F:
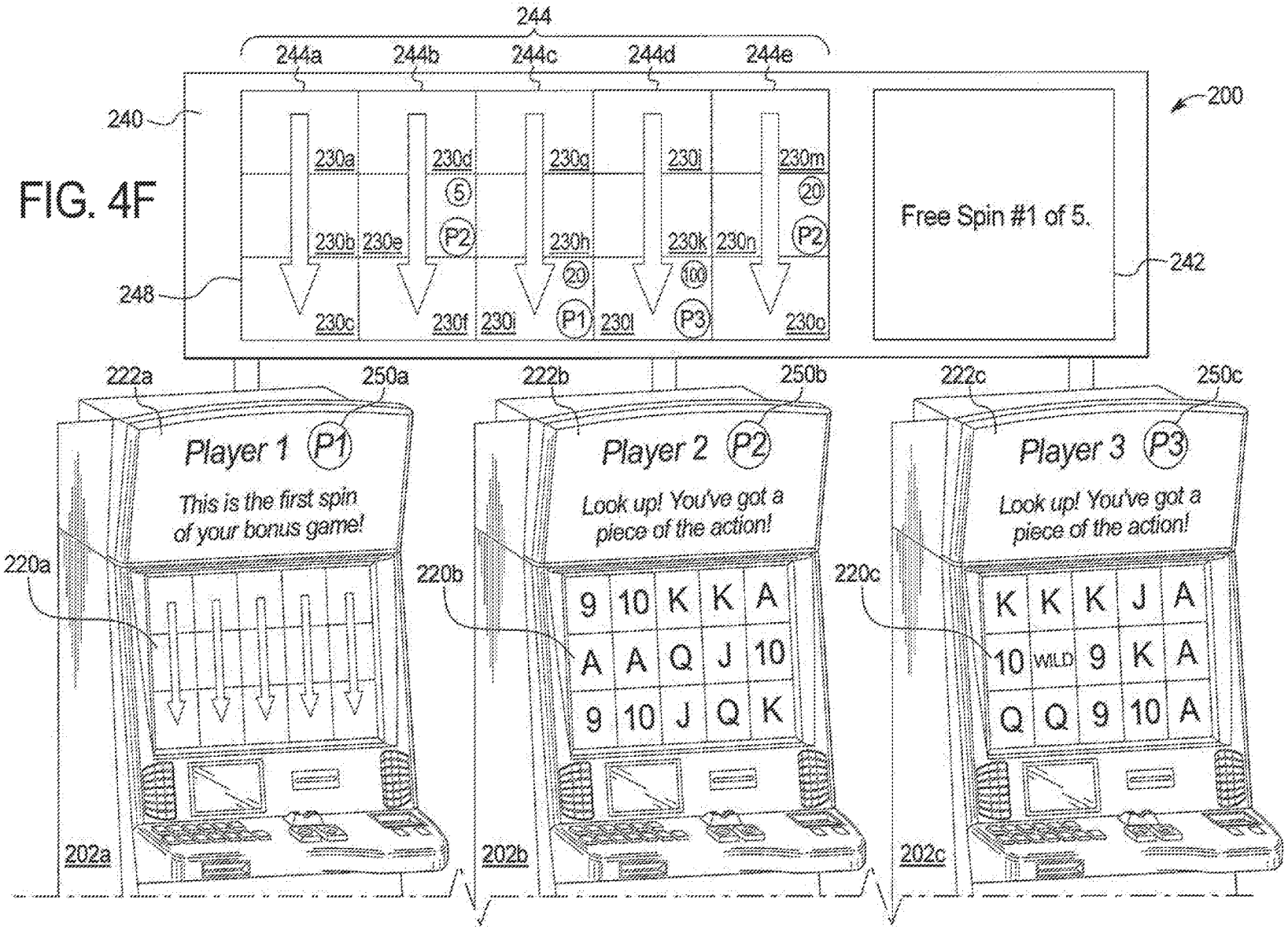

In FIG. 4F, the first of five free spins of the bonus reels 244 is displayed for all the players to see on the shared display 240. The multi-player bonus game is also displayed on the first player's gaming device 202*a* (i.e., the gaming device at which the multi-player bonus game was triggered). The second and third players are not locked out of their primary games. The second and third players may continue to play the primary games of their respective gaming devices and wait for notification of any participation award wins. It should be appreciated that the multi-player bonus game may be displayed to the players in any suitable manner. In different embodiments the multi-player bonus game may be provided to the players on a shared display associated with the gaming system or on the display device of one or more players' respective gaming devices. In one embodiment, the multi-player bonus game is displayed on the display device of one or more players' respective gaming devices in addition to being displayed on a shared display.

Figure 4G:
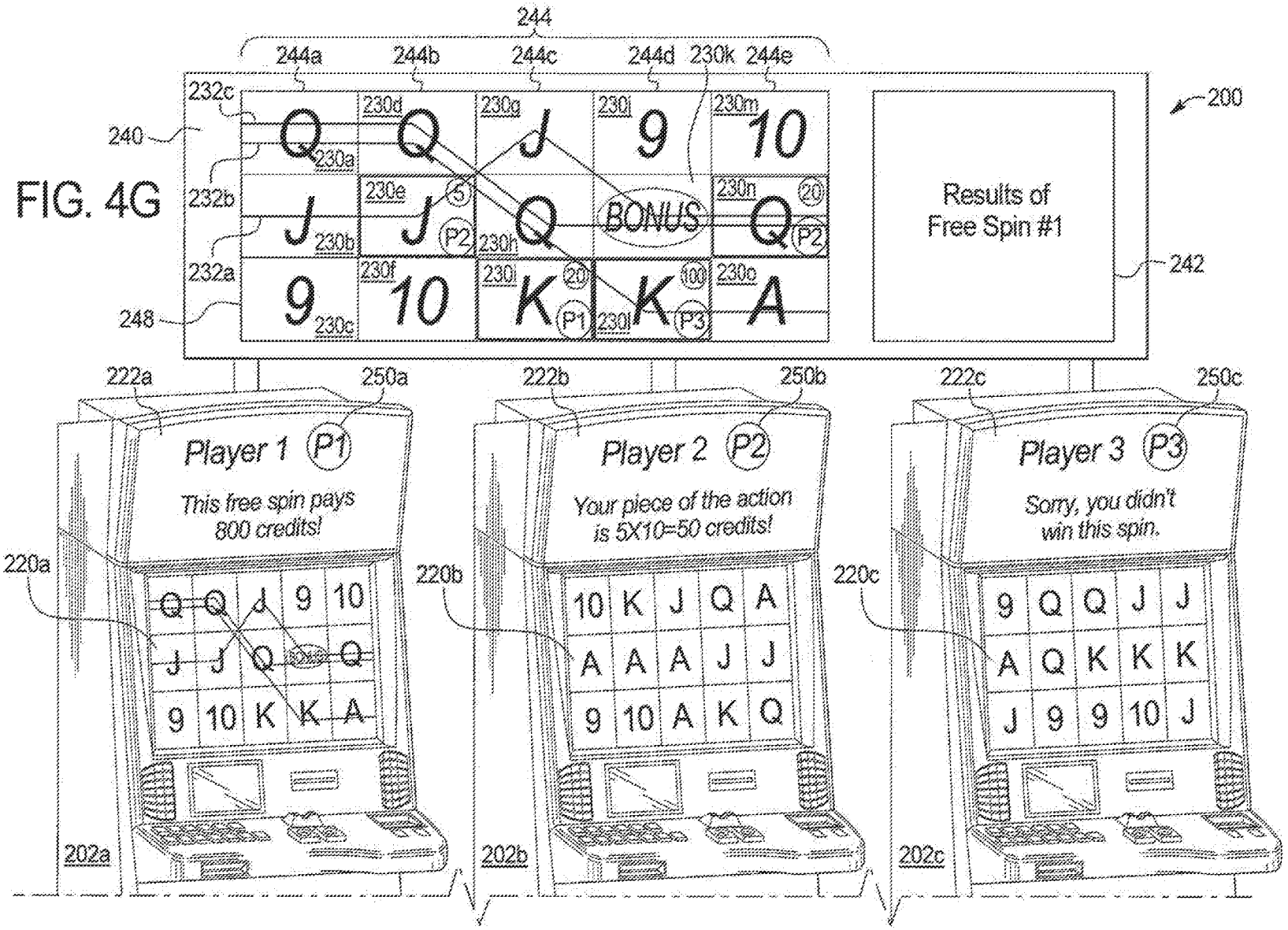

In FIG. 4G, the bonus reels 244 have stopped spinning. A first winning symbol combination including J-J-J is indicated on payline 232*a*. Another winning symbol combination including Q-Q-Q is indicated on payline 232*b* and on payline 232*c*. Accordingly, the first player wins on three different paylines. The J-J-J winning symbol combination is associated with an award of ten credits and the Q-Q-Q winning symbol combination is associated with an award of fifteen credits. Accordingly, as indicated on the secondary display device 222*a* of the first gaming device 202*a*, the first player wins a total award of eight hundred credits for the payline wins (i.e., the ten credits for J-J-J plus the fifteen credits for the first Q-Q-Q win, plus the fifteen credits for the second Q-Q-Q win, multiplied by the player's primary game wager of twenty credits).

After determining the first player's award for the payline wins in the first free spin of the bonus reels, the controller determines whether to provide any participation awards to any of the players who have accumulated at least one position on the bonus game display matrix 248. In this example embodiment, the controller determines, for each winning symbol combination formed along a payline, whether any of the symbols forming that winning symbol combination are displayed in an assigned position of the bonus game display matrix. For each symbol of each winning symbol combination which is displayed in an assigned position of the bonus game display matrix, the controller causes a participation award to be provided to the player assigned to that position. For example, if a winning symbol combination which includes three symbols is generated along a payline, for each assigned position of the bonus game display matrix that indicates one of those three symbols, the controller causes a participation award to be provided to the player assigned to that position.

Referring back to FIG. 4G, since the position assigned to the first player (i.e., position 230*i*) does not display one of the symbols forming a winning symbol combination, the first player does not win any participation awards as a result of this free spin. However, position 230*e*, which is assigned to the second player, displays one of the J symbols of the J-J-J winning symbol combination on payline 232*a*. The second player wins a participation award based on the award associated with that payline win (i.e., ten credits) and the wager amount indicated on the assigned position 230*e* (i.e., five credits, as indicated by the number "5" displayed in association with the player identifier). Thus, the participation award for the second player for this position is fifty credits, as indicated by the second display device 222*b* of the second gaming device 202*b*. It should be appreciated that the amount of the participation award may be based on the award associated with the payline win or another amount, such as according to a different paytable.

In the illustrated embodiment, even though winning paylines extend through position 230*l* (which is assigned to the third player) and through position 230*n* (which is assigned to the second player), neither of these positions displays a symbol from one of the winning symbol combinations. Accordingly, the players do not win participation awards in connection with these positions. For example, in FIG. 4G, the winning symbol combination J-J-J is indicated on payline 232*a*. However, the three J-symbols that form this winning symbol combination are displayed by symbol positions on the first three reels (i.e., positions 230*b*, 230*e*, and 230*h*). Therefore, symbol positions 230*k* and 230*n*—which are associated with the payline 232*a*, but are on the fourth and fifth reels, respectively—will not result in any participation awards for players assigned to those positions. Position 230*n* is assigned the second player. In this example, this position does not result in a participation award for the second player since it does not display one of the J symbols forming the J-J-J winning symbol combination of payline 232*a*.

It should be appreciated that, in various embodiments, different positions on the bonus game display matrix may have different expected values for the players assigned to those positions. That is, certain positions of the bonus game display matrix may have a greater probability of resulting in a participation award for the players assigned to those positions.

In this illustrated embodiment, paylines are evaluated from left to right. In view of this and the rule employed for determining participation awards, different positions on the bonus game display matrix have different expected values for the players assigned to those positions. That is, certain positions of the bonus game display matrix have a greater probability of resulting in a participation award for the players assigned to those positions. Since the paylines are evaluated from left to right, there is a better chance that a player will obtain a participation award in the multi-player bonus game if the player has an assigned position in the first, second, or third columns of the bonus game display matrix than in the fourth or fifth columns of the bonus game display matrix. This is because winning symbol combinations with three symbols are more likely to occur than winning symbol combinations with four or five symbols.

In the illustrated embodiment, to account for the different expected values associated with different positions of the bonus game display matrix, a symbol shifting operation is employed. More particularly, since the paylines are evaluated from left to right, between each of the free spins of the multi-player bonus game, each of the player identifiers or markers displayed on positions of the bonus game display matrix move or shift across one column of the bonus game display matrix. There are five columns in the bonus game display matrix of the illustrated example. Therefore, once five activations of the bonus reels are complete, each player's identifier will have been displayed once in each of the columns of the bonus display matrix, giving that player an opportunity to win a participation award one time in each column.

Figure 4H:
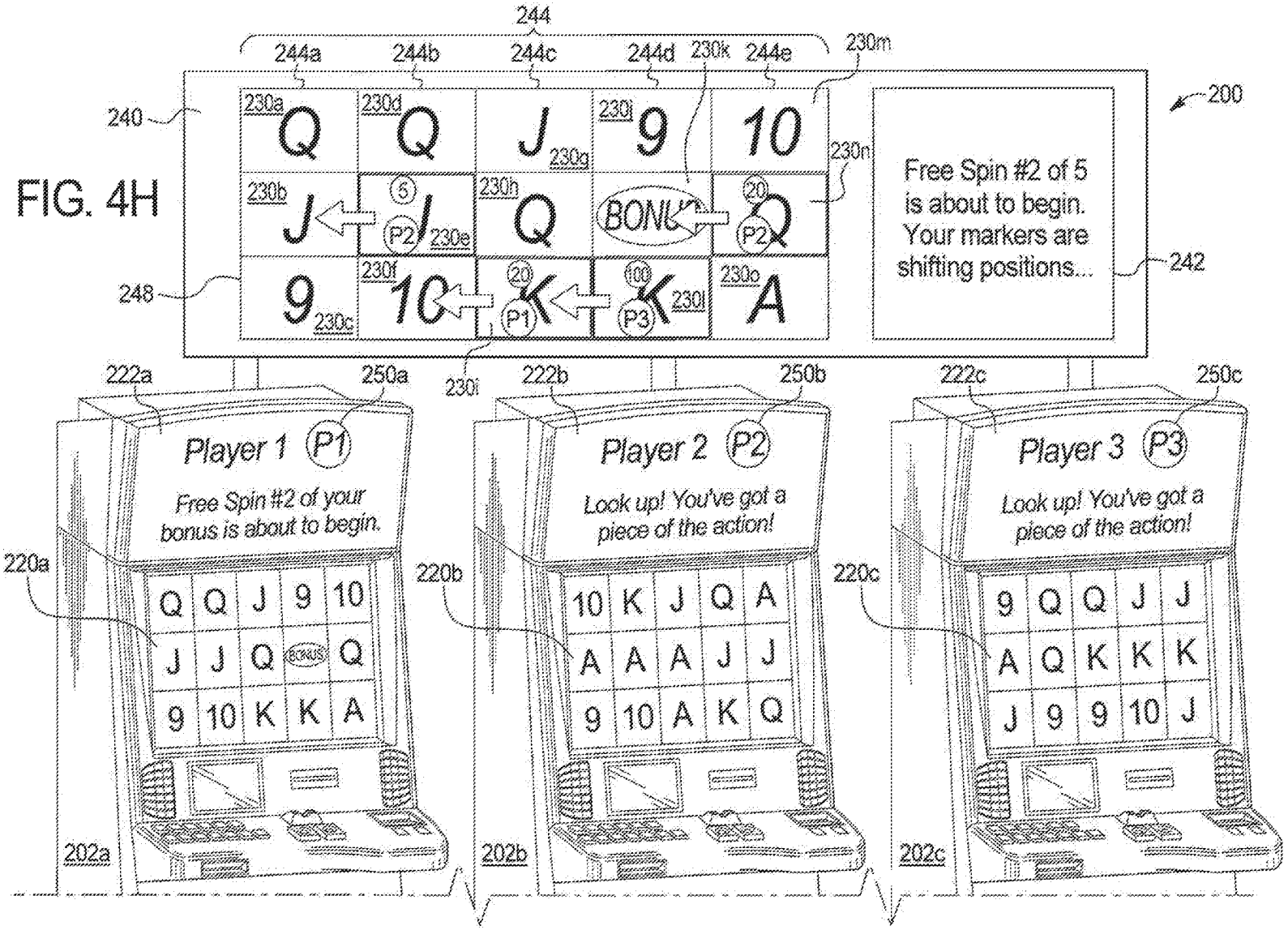

As illustrated in FIG. 4H, prior to the second free spin, each of the player identifiers or markers displayed on the bonus game display matrix shifts one position to the left. For example, the second player's marker, which was initially displayed in position 230*e*, shifts to position 230*b*. The second player's other marker, which was initially displayed in position 230*n*, shifts to position 230*k*. The first player's marker, which was initially displayed in position 230*i*, shifts to position 230*f*. The third player's marker, which was initially displayed in position 230*l*, shifts to position 230*i*. In the example of FIGS. 4A to 4N, this shifting occurs after each of the free spins of the multi-player bonus game. Since there are five free spins in the multi-player bonus game and five columns in the bonus game display matrix, each player with a marker on the bonus game display matrix will have one chance to win a participation award based on that marker in each column.

In various embodiments, the gaming system employs one or both of left-to-right payline evaluation and right-to-left payline evaluation. It should be appreciated that, if both left-to-right payline evaluation and right-to-left payline evaluation methods are employed, there is no need for the shifting operation because each of the positions of the bonus game display matrix has the same expected value.

In various embodiments, one or more different shifting/movement operations may be employed in the multi-player bonus game. For example, as seen in FIGS. 6A and 6B, in addition to column shifting, the system may provide other position shifting/movement operations which involve the player identifiers or markers shifting to different rows between free spins of the multi-player bonus game.

In one embodiment, the system provides diagonal shifting between free spins of the multi-player bonus game. For example, as illustrated in FIG. 6A, after a first free spin, a marker 250 located in a first symbol position 230*m* of the bonus game display matrix 248 moves to a second position 230*k*. After a second free spin, this marker 250 moves from the second position 230*k* of the bonus game display matrix to a third position 230*i*. After a third free spin, the marker 250 moves from the third position 230*i* of the bonus game display matrix moves up to the position in the first row of the fourth column—position 230*g*.

In another example embodiment, the markers shift from one column to a next adjacent column and column wrap-around causes a change in row. For example, as illustrated in FIG. 6B, after a first free spin, a marker 250 located in a first symbol position 230*m* of the bonus game display matrix 248 moves to a second position 230*j*. After a second free spin, this marker 250 moves from the second position 230*j* to a third position 230*g*. After a third free spin, the marker 250 moves from the third position 230*g* to a fourth position 230*d*. After a fourth free spin, the marker 250 moves from the fourth position 230*d* to a fifth position 230*a*. After the fifth free spin, the marker wraps around from the first column to the fifth column, and also changes rows. More specifically, the marker 250 moves from the fifth position 230*a* to a sixth position 230*n*.

In other embodiments, the player identifiers or markers could shift to different positions by first moving down or up columns and then wrapping around with a column shift. For example, as seen in FIG. 60, a marker 250 located in a first position 230*m* of the bonus game display matrix slides down the column by one position after each free spin. Once the marker 250 gets down to the position in the last row of the fifth column (i.e., position 2300), the marker shifts to the next adjacent position in the fourth column position 230*l*. The marker 250 then moves up the fourth column by one position after each free spin, and the movement continues in this manner. It should be appreciated that any suitable shifting/movement operation may be employed in the multi-player bonus game.

Figure 4I:
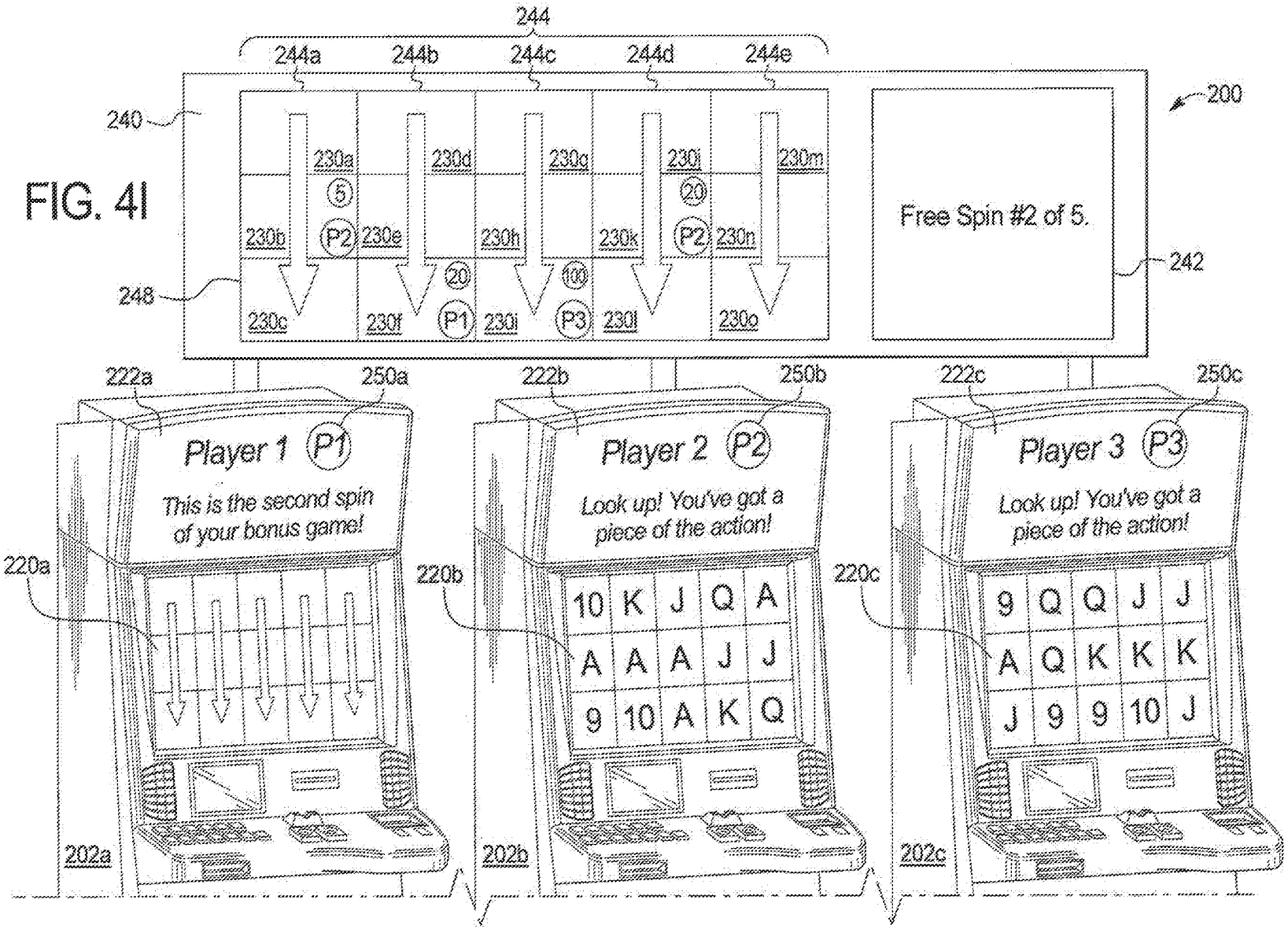

As seen in FIG. 4I, the bonus reels 244 are spinning for the second free spin of the multi-player bonus game. The second free spin of the bonus reels 244 is displayed for all the players to see on the shared display 240. The players' markers are displayed in their new positions on the bonus game display matrix 248 after the shifting operation. The multi-player bonus game is also displayed on the first player's gaming device 202*a* since the first player triggered the multi-player bonus game. The second and third players are continuing to play the primary games of their respective gaming devices as they wait for notification of any participation award wins.

Figure 4J:
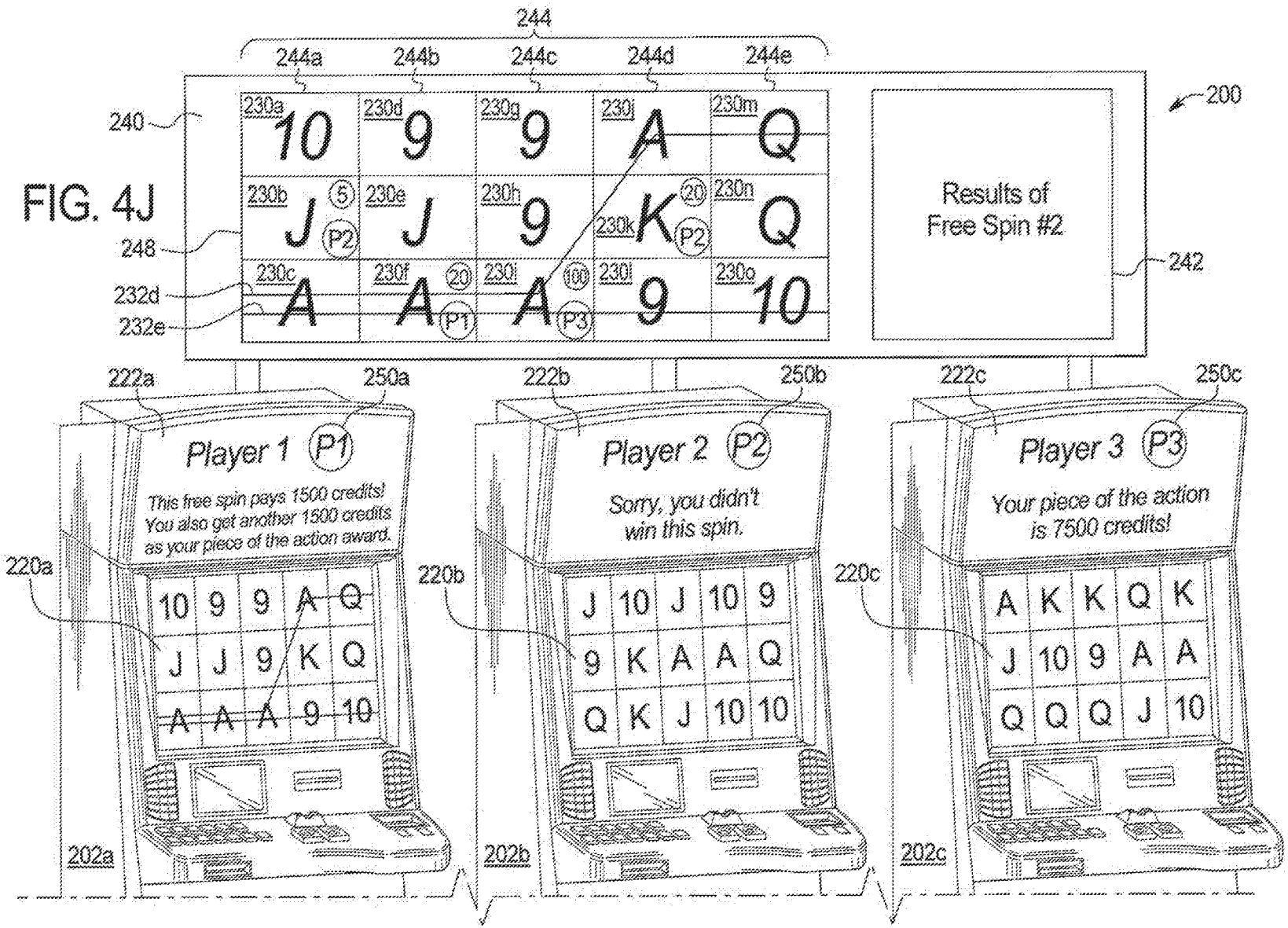

As illustrated in FIG. 4J, the outcome of the second free spin of the bonus reels 244 is displayed on the shared display 240. A winning symbol combination including A-A-A is indicated on payline 232*e*. A winning symbol combination including A-A-A-A is indicated on payline 232*d*. Accordingly, the first player wins on two different paylines. The A-A-A winning symbol combination is associated with an award of twenty five credits and the A-A-A-A winning symbol combination is associated with an award of fifty credits. Accordingly, as indicated on the secondary display device 222*a* of the first gaming device 202*a*, the first player wins 1500 credits for the payline wins (i.e., the twenty five credits for J-J-J, the fifty credits for the first A-A-A-A win, multiplied by the player's primary game wager of twenty credits).

After determining the first player's award for the payline wins in the second free spin of the bonus reels 244, the controller determines whether to provide any participation awards to any of the players who have accumulated at least one position on the bonus game display matrix 248. More specifically, for each winning symbol combination formed along a payline, the controller determines whether any of the symbols forming that winning symbol combination are displayed in an assigned position of the bonus game display matrix. As illustrated in FIG. 4J, the first player's marker is displayed in position 230*f* of the bonus game display matrix 248. This position 230*f* displays an "A" symbol which is part of both the A-A-A winning symbol combination and the A-A-A-A winning symbol combination.

The first player wins a participation award based on the award associated with the win on payline 232*d* (i.e., 50 credits for A-A-A-A) and the wager amount indicated on the assigned position 230*f* (i.e., 20 credits, as indicated by the number "20" displayed in association with the player identifier). Additionally, the player wins a participation award based on the award associated with the win on payline 232*e* (i.e., 25 credits for A-A-A) and the wager amount indicated on the assigned position 230*f* (i.e., 20 credits). That is, the first player wins participation awards of 1000 credits and 500 credits. As indicated by the second display device 222*a* of the first gaming device 202*a*, in addition to winning a bonus award of 1500 credits for the conventional payline wins, the first player also wins an additional 1500 credits in participation awards. For the first player (i.e., the player who triggered the multi-player bonus game), having positions on the bonus game display matrix resulted in a significant boost to the player's total award for the second free spin of the multi-player bonus game.

As illustrated in FIG. 4J, the third player has a marker displayed in position 230*i* of the bonus game display matrix 248. This position 230*i* also displays an "A" symbol which is part of both the A-A-A winning symbol combination on payline 232*e* and the A-A-A-A winning symbol combination on payline 232*d*. The third player wins a participation award based on the award associated with the win on payline 232*d* (i.e., 50 credits for A-A-A-A) and the wager amount indicated on the assigned position 230*i* (i.e., 100 credits, as indicated by the number "100" displayed in association with the player identifier). Additionally, the third player wins a participation award based on the award associated with the win on payline 232*e* (i.e., 25 credits for A-A-A) and the wager amount indicated on the assigned position 230*f* (i.e., 100 credits). That is, the third player wins participation awards of 5000 credits and 2500 credits. As indicated by the second display device 222*c* of the third gaming device 202*c*, the third player wins 7500 credits in participation awards.

In FIG. 4J, the second player is not assigned to any position which displays a symbol that is part of a winning symbol combination. Accordingly, as indicated by the second display device 222*b* of the second gaming device 202*b*, the second player does not win any participation awards as a result of the second free spin of the multi-player bonus game.

Figure 4K:
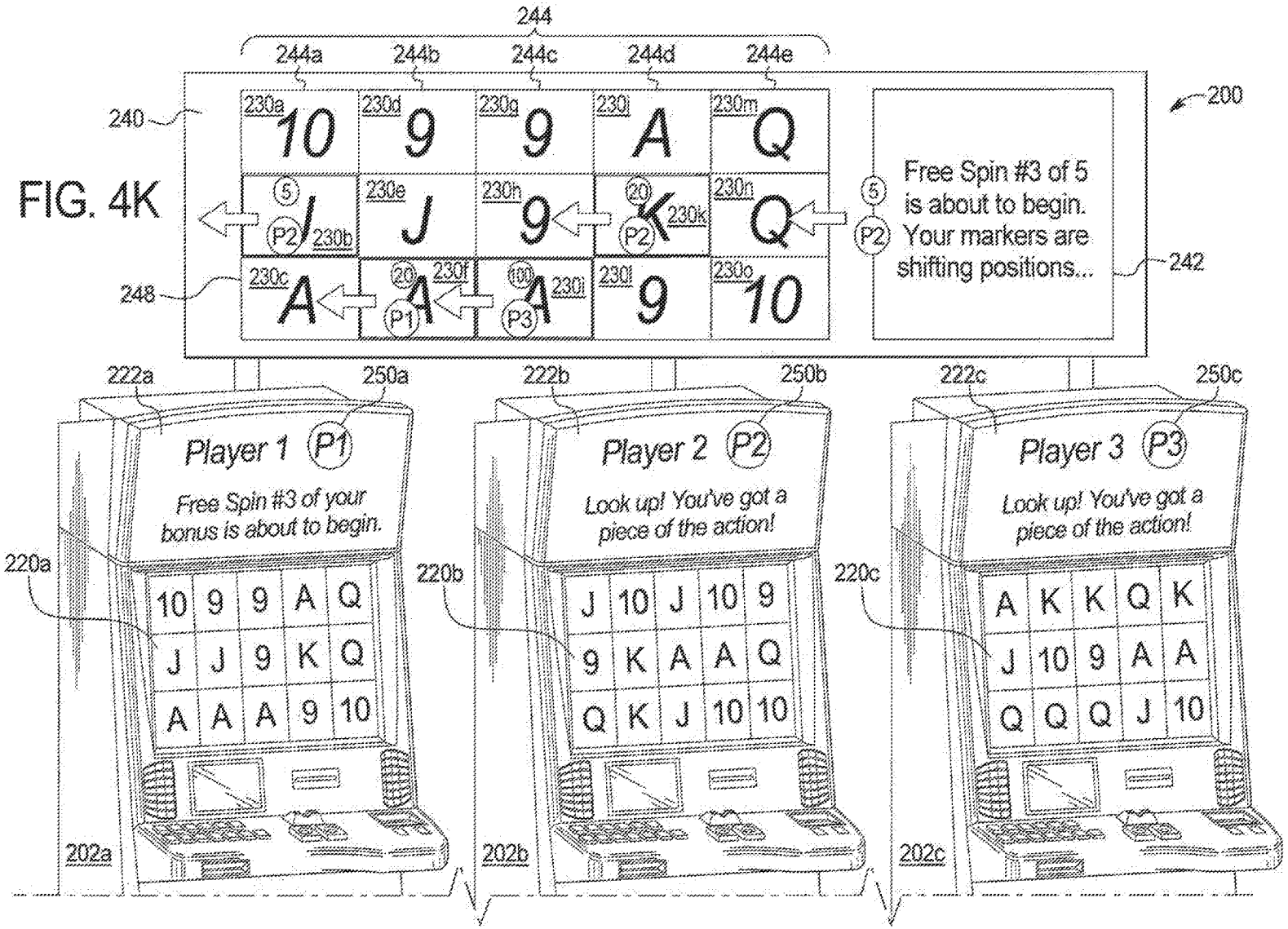

As illustrated in FIG. 4K, prior to the next (i.e., third) free spin of the bonus reels 244, each of the player identifiers or markers displayed on the bonus game display matrix shifts one position to the left. The second player's marker, which was displayed in position 230*b* for the second free spin, shifts to position 230*n*, in a wrap-around fashion. The second player's other marker, which was displayed in position 230*k* for the second free spin, shifts to position 230*h*. The first player's marker, which was displayed in position 230*f* for the second free spin, shifts to position 230*c*. The third player's marker, which was displayed in position 230*i* for the second free spin, shifts to position 230*f*. The message window 242 of the shared display 240 displays a message informing the players that the shifting operation is in process and that the third free spin is about to begin.

Figure 4L:
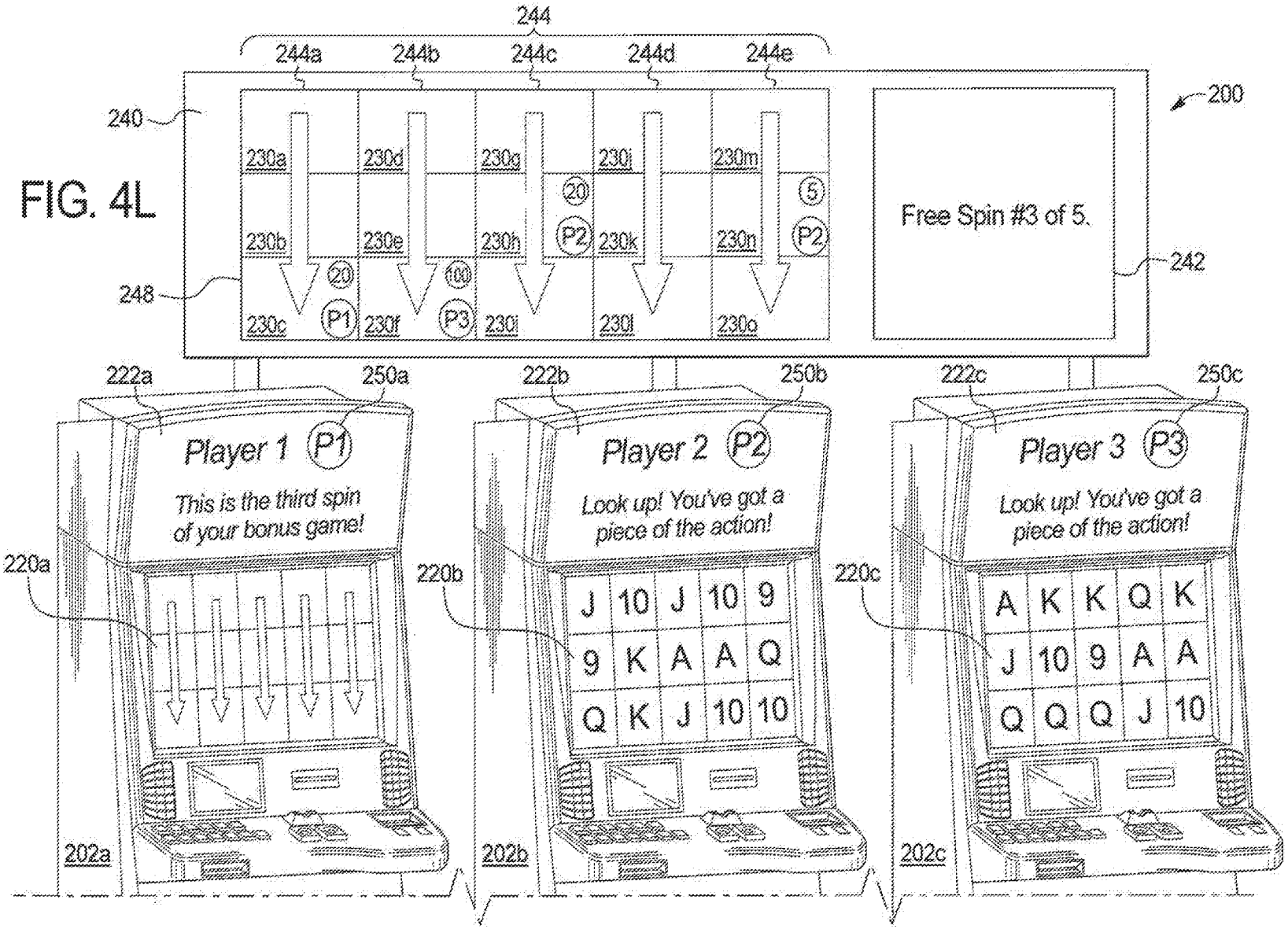

As seen in FIG. 4L, the bonus reels 244 are spinning for the third free spin of the multi-player bonus game. The third free spin of the bonus reels 244 is displayed for all the players to see on the shared display 240. The players' markers are displayed in their new positions on the bonus game display matrix 248 after the shifting operation. The multi-player bonus game is also displayed on the first player's gaming device 202*a* since the first player triggered the multi-player bonus game. The second and third players are continuing to play the primary games of their respective gaming devices as they wait for notification of any participation award wins.

Figure 4M:
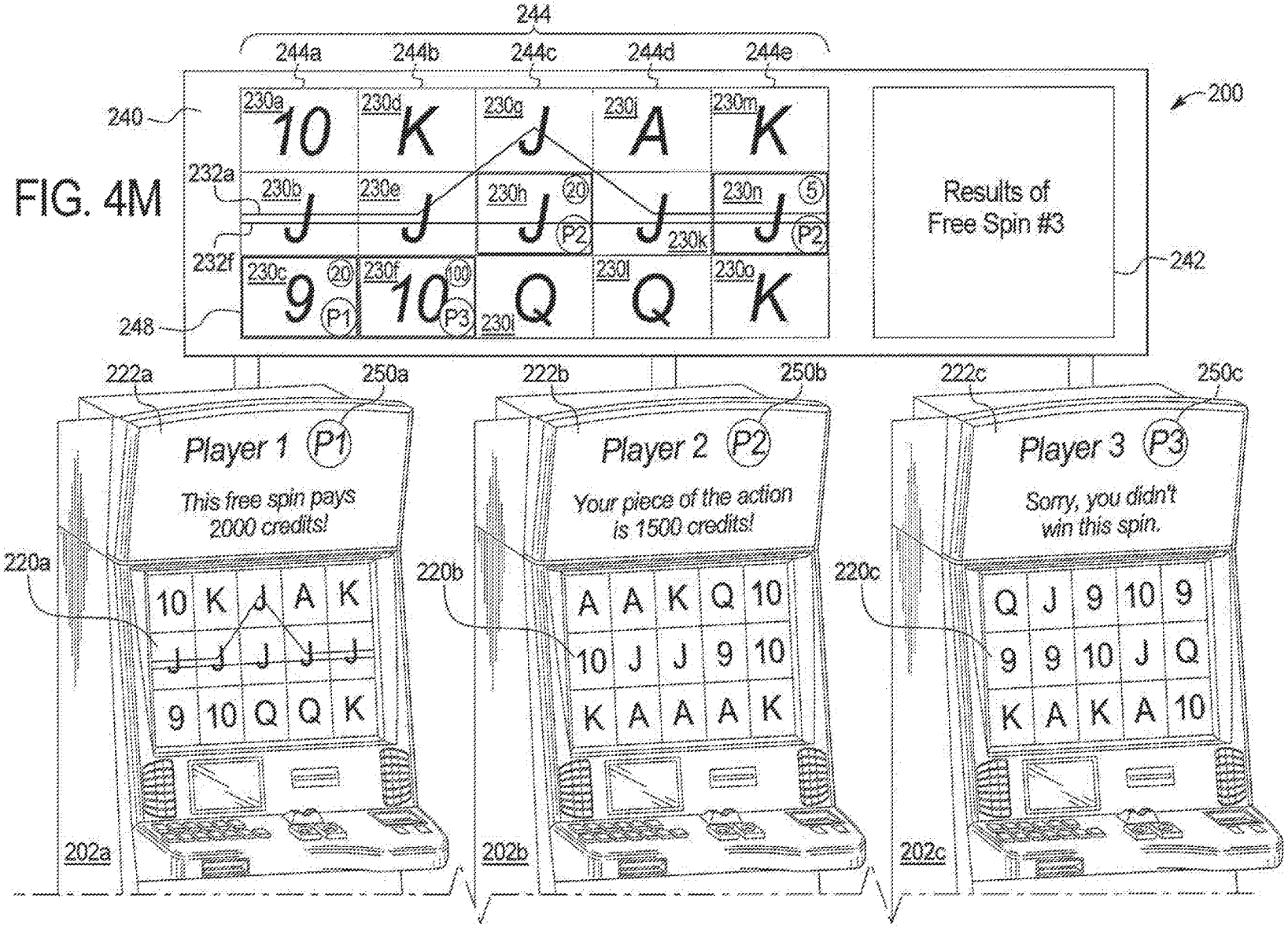
Figure 4N:
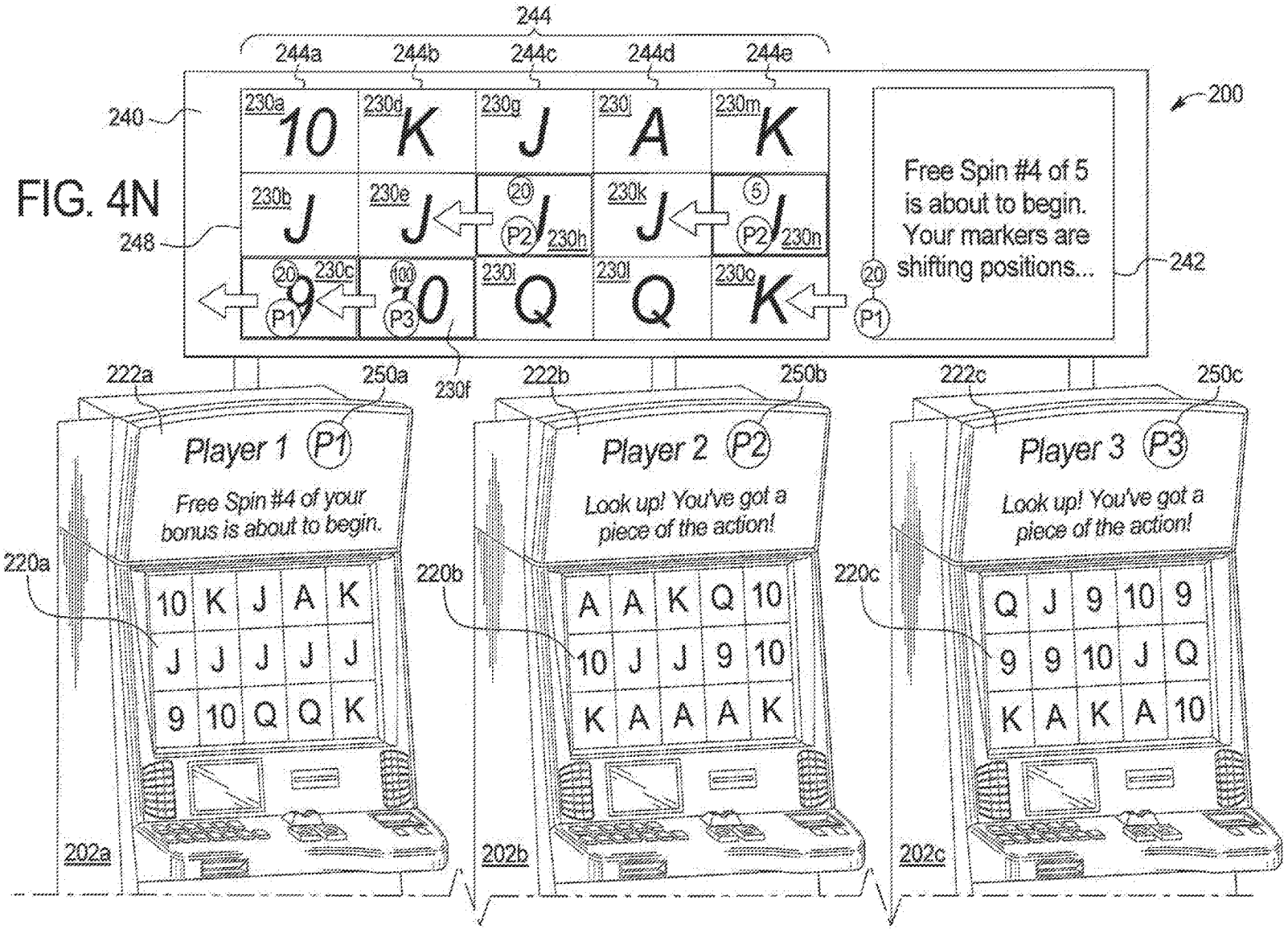

As illustrated in FIG. 4M, the outcome of the third free spin of the bonus reels 244 is displayed on the shared display 240. A winning symbol combination including J-J-J-J-J is indicated on payline 232*a*. The J-J-J-J-J winning symbol combination is also indicated on payline 232*f*. Accordingly, the first player wins on two different paylines. The J-J-J-J-J winning symbol combination is associated with an award of fifty credits. Accordingly, as indicated on the secondary display device 222*a* of the first gaming device 202*a*, the first player wins 2000 credits for the payline wins (i.e., the fifty credits for the first J-J-J-J-J win, plus the fifty credits for the second J-J-J-J-J win, multiplied by the player's primary game wager of twenty credits).

After determining the first player's award for the payline wins in the third free spin of the bonus reels 244, the controller determines whether to provide any participation awards to any of the players who have accumulated at least one position on the bonus game display matrix 248. More specifically, for each winning symbol combination formed along a payline, the controller determines whether any of the symbols forming that winning symbol combination are displayed in an assigned position of the bonus game display matrix. As illustrated in FIG. 4M, the first and third players are not assigned to any positions displaying a symbol that is part of a winning symbol combination. Accordingly, these players do not win any participation awards as a result of the third free spin of the multi-player bonus game.

The second player has two markers on the bonus game display matrix—one is displayed at position 230*h* and the other is displayed at position 230*n*. Position 230*n* (at which the second player has a marker associated with a primary game wager of 5 credits) displays a "J" symbol which is part of both the J-J-J-J-J winning symbol combination indicated on payline 232*a* and the J-J-J-J-J winning symbol combination indicated on payline 232*f*. Thus, the player wins two participation awards for this position. Each of the participation awards for this position has a value of 250 credits (i.e., 50 credits for the J-J-J-J-J, multiplied by the player's wager of 5 credits).

Position 230*h* (at which the second player has a marker associated with a primary game wager of 20 credits) displays a "J" symbol which is part of the J-J-J-J-J winning symbol combination indicated on payline 232*f*. The second player wins a participation award of 1000 credits for this position (i.e., 50 credits for the J-J-J-J-J, multiplied by the player's wager of 20 credits). As indicated by the second display device 222*b* of the second gaming device 202*b*, the second player wins 1500 credits in participation awards. In the illustrated example, it does not matter that two positions are associated with the same winning payline. Each position pays separately.

As illustrated in FIG. 4N, prior to the next (i.e., fourth) free spin of the bonus reels 244, the shifting operating occurs once more, with each of the player markers on the bonus game display matrix shifting one position to the left. The above-described process continues until each of the free spins is complete and each player's marker has been displayed in each of the five columns of the bonus game display matrix. After the fourth and fifth free spins of the multi-player bonus game (not shown), the bonus game display matrix is cleared of all player markers. Any previously assigned positions are made available for re-assignment for the next multi-player bonus game.

As seen in the example embodiment of FIGS. 4A to 4N, for each occurrence of a designated position earning event, a player can accumulate positions on the bonus game display matrix. When the multi-player bonus game is triggered, any player who has accumulated at least one position on the bonus game display matrix has the chance to win participation awards, regardless of which player triggered the multi-player bonus game. Through the use of a shifting operation (which involves shifting each of the players' markers displayed on the bonus game display matrix to a position in an adjacent column in between each of the free spins), each player's chance of winning (or the expected value of the free spin for the player) changes for each free spin, providing additional excitement and an increased level of fairness in the multi-player bonus game.

In one alternative embodiment, for a position to result in a participation award for a player, that position does not need to display a symbol from a winning symbol combination. Instead, the position only needs to be associated with a payline that includes a winning symbol combination. That is, the controller determines for each payline which indicates a winning symbol combination, whether any of the positions associated with that payline are assigned to a player. The controller causes a participation award to be provided to each player assigned to a position associated with a payline which indicates a winning symbol combination. For example, a payline is associated with five positions of the bonus game display matrix and a player is assigned to the fifth position (i.e., the player's unique player identifier is displayed at the fifth position). If a winning symbol combination which includes four symbols is generated along that payline, the player may still receive a participation award for having a player identifier in the fifth position. In this example, the fifth position does not display a symbol that is part of the winning symbol combination, but it is along the payline that indicates the winning symbol combination.

In one embodiment, the position earning event is based on an accumulation of points. In one such embodiment, each player earns points based on events which occur in plays of the primary game. The number of points each player earns may be determined based on the type of primary game event, the amount wagered, the speed of play, player status, or any other suitable criteria. The players can exchange accumulated points for positions on the bonus game display matrix. In one embodiment, different positions of the bonus game display matrix require different numbers of points. In another embodiment, a player may exchange accumulated points for a number of positions, but the controller randomly determines which positions are assigned to that player.

In one embodiment, the position earning event is based on an accumulation of designated symbols. In one such embodiment, each time a designated symbol is generated in a play of the primary game, the designated symbol is added to a tracked quantity of the designated symbols associated with a player. Once the player's tracked quantity of the designated symbols reaches a designated level, the player earns a position of the bonus game display matrix.

In another embodiments, a position earning event is based on filling an accumulator, such as a meter. For example; each time a designated symbol is generated in a play of the primary game at a gaming device, a meter is incremented by a designated amount. In one embodiment, the amount by which the accumulator increments is based at least in part on the player's wager. Once the meter is completely filled, the player of the gaming device earns a position on the bonus game display matrix. In one embodiment, different positions of the bonus game display matrix require different accumulators to be filled. In another embodiment, when an accumulator is filled, the player gets a position, but which position is assigned to the player is randomly determined.

In one embodiment, the controller assigns each player to one or more reel columns. Positions are earned based on events that occur in a given players reel column. For example, a player may earn positions on the bonus game display matrix for getting fully stacked wilds, or a certain sub-symbol, or a stack of sub-symbols, etc. in a reel column assigned to the player.

In certain embodiments, a player only earns or accumulates a position on the bonus game display matrix if the player has received a negative result in the play of the primary game. Thus, accumulating a position is a consolation for the player losing or obtaining an unfavorable outcome in the play of the primary game. In these embodiments, the negative player experience of losing the primary game to the dealer (or obtaining another unfavorable outcome) is at least partially offset by the positive occurrence of accumulating one or more positions on the bonus game display matrix.

In one embodiment, the position earning event is based on an event triggered by a primary game outcome which causes a secondary determination (e.g. spin of the wheel) to occur.

In other embodiments, the position earning event is not based on any displayed event in any play of the primary game, such as a mystery trigger. It should be appreciated that the position earning event may be any suitable event or outcome.

In various alternative embodiments, when a position earning event occurs, the number of positions assigned to a player is predetermined, randomly determined, based on a generated symbol (or sub-symbol) or combination of symbols (or sub-symbols), based on a number of generated symbols (or sub-symbols) or combinations of symbols (or sub-symbols), determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria. In one embodiment, the central controller awards different numbers of positions for different types of position earning events.

In one embodiment, when a position earning event occurs for a player, the number of positions assigned to that player varies based on which column of the bonus game display matrix positions are located in. For example, a player may earn: (i) one position in the first column of positions on the bonus game display matrix, (ii) one position in the second column of positions on the bonus game display matrix, (iii) one position in the third column of positions on the bonus game display matrix, (iv) two positions in the fourth column of positions on the bonus game display matrix, and (v) four positions in the fifth column of positions on the bonus game display matrix. In one embodiment where players can win participation awards for having positions that display symbols which are part of a winning symbol combination, when players earn positions in the fourth and fifth columns, the system compensates those players with more positions in the fourth and fifth columns, since each of those positions is less valuable than positions in the first, second, and third columns. This is because, in such embodiments, getting three matching symbols on a payline is more likely than getting four or five matching symbols on a payline.

In certain embodiments, as described above, when a position earning event occurs for a player, the controller randomly determines or selects which position to assign to each player. In one embodiment, which position is assigned to a player is based at least in part on that player's wager. In one embodiment, the bigger the player's bet is, the better the player's chance of getting a better position on the bonus game display matrix. In this embodiment, the controller still randomly determines or selects which position is assigned to the player, but the odds of getting certain positions increases based on the player's wager.

In one embodiment, when a position earning event occurs for a player, the controller randomly determines or selects which position to assign to the player based on an event associate with a displayed mechanism, such as a mechanical or virtual wheel or any other suitable mechanism.

In some embodiments, which positions are assigned to players is based on the type or value of the position-earning event. For example, if the position-earning event includes an occurrence of a designated number of symbols (or sub-symbols) in the primary game, the greater the number of designated symbols (or sub-symbols) obtained in that play of the primary game, the better the position assigned to the player will be. In another example, the greater the value of any designated symbol (or sub-symbol) obtained by the player in the play of the primary game, the better the position assigned to the player will be.

In one embodiment (such as in the example embodiment of FIGS. 4A to 4N described above) each time a player earns a position on the bonus game display matrix, the assignment of that position occurs immediately or simultaneously. That is, after an occurrence of a position earning event for a player, the controller assigns the player a position and causes the player's identifier or marker to be displayed in the assigned position. In an alternative embodiment, each player accumulates positions of the bonus game display matrix based on position-earning events which occur during game play, but the assignment of positions only occurs once the multi-player bonus game has actually been triggered. In other words, position assignments are queued until the multi-player bonus game is triggered. In one embodiment, as the players play the primary games, the controller tracks the number of positions that each player has earned and displays a list of which players have positions and how many positions each player has. However, the controller does not actually assign positions to the players until the multi-player bonus game is triggered. In various alternative embodiments where position assignments are queued until the multi-player bonus game is triggered, the order in which positions are assigned to players may be based on one or more factors, including when the position was earned, the player's primary game wager, the value of the position earning event, the player's status, or any other suitable factor. In one example, the first player to earn a position may be assigned a position first. In another example, the player who placed the highest wager may be assigned a position first. In another example, the player who obtained the highest-valued position earning event may be assigned a position first. In another example, the player with the highest club status may be assigned a position first.

In one embodiment, two or more players can share (i.e., have player identifiers or markers on) the same position. In one embodiment, a single player may have more than one player identifier or marker on a single position. In one such embodiment, if the player is assigned to the same position twice, the controller provides the player with an opportunity to upgrade to a better position. In one embodiment, if no better position is available, the controller provides the player with a multiplier for the position that the player is already assigned to.

In one embodiment, if two players simultaneously earn a position on the bonus game display matrix, and there is only one available position left, the controller assigns the position to the player whose request it gets to first. The controller transmits a message to the gaming devices of each of the other player(s) to inform the player(s) that they have earned a position on the bonus game display matrix for the next multi-player bonus game.

In one embodiment, each player's gaming device communicates with the central controller before displaying an outcome that leads to a player earning a position of the bonus game display matrix or triggering the bonus game. This ensures that players never see conflicting information when there are simultaneous or near-simultaneous occurrences of either position earning events or bonus game triggering events at multiple gaming devices. For example, if a first player and a second player have near-simultaneous occurrences of a position earning event, the second player sees a position being allocated to the first player before the second player's position earning event is actually displayed to the second player.

In one embodiment, if there are no positions available for assignment on the bonus game display matrix and the multi-player bonus game has not been triggered, the controller causes the multi-player bonus game to be triggered. In this case (i.e., in the case of a "system multi-player bonus round"), none of the players are eligible to earn conventional bonus awards during the bonus game (such as for winning symbol combinations generated during each free spin of a free spins multi-player bonus game). However, any assigned positions of the bonus game display matrix can produce participation awards. Alternatively, the controller randomly selects one of the players to play out the multi-player bonus game (and thus have the potential to earn conventional bonus awards during the bonus game). Similarly, any assigned positions of the bonus game display matrix can produce participation awards.

In another embodiment, if there are no positions available for assignment on the bonus game display matrix and the multi-player bonus game has not been triggered, the controller adds a row to the bonus game display matrix. For example, if all of the positions of a 3×5 bonus game display matrix are assigned to players, the controller adds a row to the matrix, turning it into a 4×5 bonus game display matrix. In one such embodiment, the controller offers the player who triggers the bonus game to pay an extra fee to play the multi-player bonus game with a 4×5 matrix instead of a 3×5 matrix. In another embodiment, the controller provides the player of the triggering gaming device with fewer free spins on the 4×5 matrix. In one embodiment, the controller enables the player to utilize a subset of the increased matrix to utilize for the bonus game. In one such embodiment, the controller always provides the player the same sub-set. In another embodiment, the sub-set changes (e.g., a different sub-set is utilized for one or more free spins of the mufti-player bonus game). In another embodiment, the controller enables the player to choose which sub-set of the increased matrix to use for the bonus game. For example, the controller enables the player to choose whether to use the top three rows of the 4×5 matrix or the bottom three rows of the 4×5 matrix.

In one embodiment, if there are no positions available for assignment on the bonus game display matrix and the multi-player bonus game has not been triggered, if player already has at least one assigned position, the controller awards the player a multiplier for that position, such that any participation awards won based on that position are enhanced by the multiplier.

In another embodiment, if there are no positions available for assignment on the bonus game display matrix and the multi-player bonus game has not been triggered, any positions subsequently earned by a player may be saved and applied for the next multi-player bonus game. In various embodiments, one or more of the approaches described above may be used to assign positions to players who have accumulated positions after all the positions of the bonus game display matrix are already assigned.

In one embodiment, "spoiler" events can cause a player to lose positions on the bonus game display matrix. In one such embodiment, such spoiler events occur during primary game play. For example, if the primary game results in a designated spoiler symbol indicated on the reels, this causes the player to lose one, a plurality, or all of the player's markers on the bonus game display matrix. In different embodiments, the number of positions lost is predetermined, randomly determined, determined based on a generated symbol or symbol combination, determined based on a random determination by the central controller, determined based on a random determination at the gaming machine, determined based on time (such as the time of day), determined based on a primary game wager, determined based on an amount of coin-in accumulated in one or more pools, or determined based on any other suitable method or criteria.

In various embodiments, players may earn items other than positions on a bonus game display matrix. In one such embodiment, instead of (or in addition to) assigning a player a position on the bonus game display matrix, the controller assigns the player a specific symbol. For example, the controller assigns the player to the "J" symbol. When the multi-player bonus game is triggered, the controller causes a participation award to be provided to the player for each occurrence of a winning symbol combination which includes the specific symbol assigned to the player. In another variation, the participation award is based how many of the specific symbols occur in (i.e., are displayed in) the result of the multi-player bonus game.

In one embodiment, instead of (or in addition to) assigning a player a position on the bonus game display matrix, the controller assigns the player to a category of symbols, such as; (i) low royal symbols, (ii) high royal symbols, minor symbols, major symbols, or wild symbols. When the multi-player bonus game is triggered, the controller provides the player a participation award for each occurrence of a winning symbol combination which includes a symbol in the category of symbols assigned to the player. In another variation, the participation award is based how many symbols from the assigned category occur in (i.e., are displayed in) the result of the multi-player bonus game.

In one embodiment, instead of (or in addition to) assigning a player a position on the bonus game display matrix, the controller assigns a payline or set of paylines associated with the multi-player bonus game to the player. In such an embodiment, when the multi-player bonus game is triggered, any award which occurs on an assigned payline (or set of paylines) results in a participation award for that player.

In other embodiments, instead of (or in addition to) assigning a player a position on the bonus game display matrix, the controller assigns the player one or more rows of positions and/or columns of positions of the bonus game display matrix. In one such embodiment, the player is paid for all wins that start with a symbol displayed by on one of that player's positions. In another embodiment where the player can earn a row of positions, the player is paid proportionately for all winning symbols on the player's row.

In one embodiment, when a player earns a position of the bonus game display matrix, the controller assigns the player a column and enables the player to choose a row. The player is assigned to the position in the player-selected row of the controller-selected column.

In one embodiment, instead of (or in addition to) assigning a player a position on the bonus game display matrix, the controller assigns the player a win configuration. For example, the controller provides the player with a participation award when there is a win on a designated number of paylines in the multi-player bonus game, such as 1, 2, 3, 4, or 5 paylines. In one such embodiment, the participation award is a predetermined participation award amount. In another embodiment, the participation award is based on a predetermined participation award amount and the player's primary game wager. In another embodiment, the participation award is based on one or more of the payline wins that result in the participation award. In another embodiment, the participation award is based on one or more of the payline wins that result in the participation award and the player's primary game wager.

In certain embodiments where the multi-player bonus game includes a number of free spins or free activations, instead of (or in addition to) assigning a player a position on the bonus game display matrix, the controller assigns the player a particular one of the free spins (or a set of the free spins). When the bonus game is triggered, the player assigned to a particular spin (or set of spins) gets the total pay awarded for that spin (or set of spins), even if the assigned player is not the player who triggered the multi-player bonus game.

In one embodiment, instead of (or in addition to) assigning a player a position on the bonus game display matrix, the controller assigns the player a particular sub-symbol. In one such embodiment, when the multi-player bonus game is triggered, any win in the multi-player bonus game that includes the player's sub-symbol results in a participation award for the player. In one such embodiment, the amount of the participation award is determined based on the total pay involving that sub-symbol. In another embodiment, the amount of the participation award is determined based on a proportion of the pay involving that sub-symbol. In another embodiment, the sub-symbol assigned to a player can be the player's identifier or marker which gets displayed on positions of the bonus game display matrix that are assigned to that player. In another embodiment, if a player is assigned to more than one sub-symbol within a bonus game, this increases the player's multiplier or adds more of that sub-symbol to the reels.

In one embodiment, instead of (or in addition to) assigning a player a position on the bonus game display matrix, the controller assigns the player a bonus award percentage. For example, the player is assigned a share or percentage, such as 25%. In one embodiment, the share could be a predetermined or predefined amount, like 25%, or could be variable. In certain embodiments, the variable share percentage could be displayed either before start of bonus or after bonus is completed.

In addition to (or instead of) providing payline-based pays for player positions, the controller assigns a symbol (or sub-symbol) to each player, and an occurrence of that symbol (or sub-symbol) in a position assigned to that player results in an award or advantage for the player. For example, when a particular player's assigned symbol (or sub-symbol) is displayed in a position assigned to that player during the multi-player bonus game, that position may result in: (i) payment of a participation award to the player, (ii) the position becoming wild for just that player; and/or (iii) the position becoming associated with a multiplier. In certain embodiments, when a particular player's assigned symbol (or sub-symbol) is displayed in a position assigned to that player during the multi-player bonus game, that position becomes wild for all players.

In one embodiment, different positions of the bonus game display matrix may be associated with different multipliers. In one such embodiment, different positions may be associated with different multipliers based on their respective locations on the bonus game display matrix. In one embodiment where players can win participation awards for having positions that display symbols which are part of a winning symbol combination, when players earn positions on the bonus game display matrix in the fourth and fifth columns, the system compensates those players with higher multipliers for those positions since each position in the fifth and fourth columns is less valuable than positions on the first, second, and third columns. This is because getting three matching symbols on a payline is more likely than getting four or five matching symbols on a payline.

In one embodiment, the controller enables players to upgrade from one position to a better position of the bonus game display matrix, such as by paying a fee to purchase a position-upgrade at start of the multi-player bonus game. In another embodiment, the controller enables players to obtain better positions in lieu of an earned win.

In some embodiments, each, a plurality, of all of the symbol positions of the bonus game display matrix may be configured to display more than one symbol. In one such embodiment, when a player is assigned to a particular position, the player may win participation awards when two or more coinciding or related symbols appear within that position.

In one embodiment, only players who are actively playing at one of the gaming devices (i.e., in active status) are eligible to win participation awards in the multi-player bonus game. In one embodiment, active status means that the gaming device is being actively played by a player and enrolled/inactive status means that the gaming device is not being actively played by a player. The active status requirements can be based on any suitable number of satisfied criteria or defined in any suitable manner by the implementer of the gaming system. For instance, a play of or wager on the primary game of the gaming device within a predetermined period of time may be part of the determination of whether that gaming device is in the active status. Other factors such as: (a) the amount of time between each play of or wager on the primary game of the gaming device; (b) the amount being wagered on the primary game(s); and (c) the number of plays within a period of time, may also or alternatively be part of the determination of whether a gaming device is in the active status; (d) the existence of credits on the gaming device may also or alternatively be part of the determination of whether a gaming device is in the active status. On the other hand, inactive status means that the gaming device is one of the gaming devices in the gaming system, but is not in the active status (i.e., not being actively played by a player according to one or more of the predetermined criteria). In certain embodiments, when a player is no longer actively playing a gaming device, that player's positions may be returned and may be subsequently awarded to other players who are still actively playing at one of the gaming machines. This helps to ensure that bonus awards are provided to players who are actually participating in game play.

In one embodiment, if a player discontinues wagering on the primary game, such as by leaving or cashing out of the gaming device, all of that player's accumulated positions are forfeited. In alternate embodiments, the player may be allowed to save the accumulated positions. In another embodiment, when a player leaves a gaming device, the accumulated positions are stored on an internal or portable memory device, printed on a machine-readable ticket or stored in memory. It should also be appreciated that in one embodiment the bonus game may be tied to the player's player tracking card which will enable the player to store and retrieve any accumulated positions.

In one embodiment, the player's positions will be saved for a limited amount of time. In another embodiment, system enables the player to take any accumulated positions with them for future play. In another embodiment, the player loses positions if that player does not make a wager after a certain amount of time (such as thirty seconds, or any other suitable amount of time set by manufacturer and/or by operator). In one embodiment, the controller keeps track of the amount of time before the player must return to wagering on the primary game. If the time expires, any accumulated positions may be forfeited or suitably stored for later play. In another embodiment, the controller enables the player to monetize their positions. For example, the player could trade in any accumulated positions for a random award. In another embodiment, if a first player cashes out and leaves the primary game having accumulated at least one position, a new second player may start playing in place of the first player and have the option of using the first player's accumulated positions. In another embodiment, any accumulated positions remain active and any awards are paid into a player account after the multi-player bonus game occurs. In one such embodiment, the player has ability to view a recreated visual experience of the multi-player bonus game, if desired.

In some embodiments where the system associates a unique player account to each player, a player's accumulated positions remain active even if that player discontinues play. In the case where an inactive player's accumulated position earns that player an award, that award is automatically paid to that player's associated player account. In one embodiment, the association of a player to a player account is via a player registration process. In another embodiment, the association of a player to a player account is accomplished via a one-time association, the association's linkage being stored on a linkage storage device, such as a machine-readable ticket dispensed to the player or any other suitable mechanism. In one such embodiment, any winnings associated with a player account can be redeemed by the player associated with that account when that player inserts his or her association linkage storage device into an appropriate linkage storage device reader connected to the system.

In one embodiment, the multi-player bonus game auto triggers at certain time intervals (such as every five minutes) so that no player has to wait too long to see whether or not they will win any awards based on any accumulated positions.

In certain embodiments, it is possible for players to win positions on the bonus game display matrix as the multi-player bonus game is being played. In one such embodiment, players can earn positions on the bonus game display matrix based on events or outcomes of the multi-player bonus game. In one embodiment, positions earned based on events or outcomes of the multi-player bonus game are added to the bonus game display matrix for the current round of the multi-player bonus game (assuming there are available positions on it). If no positions are available, the positions earned are queued for display on the bonus game display matrix for a next round of the multi-player bonus game. In another embodiment, positions earned based on events or outcomes of the multi-player bonus game are queued for display on the bonus game display matrix for a next round of the multi-player bonus game. For example, if the player playing the bonus game (i.e., the player of the triggering gaming device) obtains a position earning event, such as a designated combination of symbols or sub-symbols in the bonus game, the controller assigns the player another position: (i) immediately (i.e., the position may be used to win awards during the current round of the multi-player bonus game); or (ii) is it queued for a future round of the multi-player bonus game. In other embodiments, if another player is assigned to a position involved in the position earning event; that player also earns another position, for either immediate use in the current round of the multi-player bonus game or for a future round of the multi-player bonus game.

In one embodiment, if a first player has triggered the multi-player bonus game and then a second player triggers the multi-player bonus game when the first player is already in the bonus game, the second player's bonus game immediately starts on the display device of that player's gaming device only. In another embodiment, the second player's bonus game is queued to be displayed on the shared display for all players to see as soon as the first player's bonus game is completed. In various embodiments; the second player may or may not be able to continue playing the primary game of his or her respective gaming device until this occurs. In one embodiment, any positions earned by any player during the first player's bonus game are assigned to the bonus game display matrix for the second player's bonus game before the second player's bonus game starts. In one embodiment, the second player can choose whether to start his or her bonus game immediately (on that player's display only) or to have his or her bonus game queued to play on the shared display as soon as the first player's bonus game is completed. In some embodiments, a plurality of or all of the players may see how many player bonus games are presently queued.

In one embodiment, when a player triggers the bonus game, a number of free spins or activations of the bonus reels are provided. In addition to earning participation awards when one or more of that player's earned positions is part of a winning symbol combination, the player can also earn more free spins if a bonus retrigger event occurs. For example, the player may earn more free spins if one or more bonus retrigger symbols appear in one or more of that player's positions on the bonus game display matrix. When a bonus retrigger event occurs, the player who originally triggered the bonus enjoys the benefits of more free spins. In one embodiment, each of the other players who had positions on the bonus game display matrix keeps those positions in the additional spins. In another embodiment, each of the other players who had positions on the bonus game display matrix only keeps his or her positions in the additional free spins if one or more of the bonus retrigger symbols appeared in one or more of that player's positions. In some embodiments, in order to compensate players with positions on the fourth and fifth columns (which, in some cases, are less valuable than positions on the first, second, and third columns), the bonus game may be designed such that bonus retrigger symbols are more likely to appear in positions of the fourth and fifth columns than other columns. This way, when a bonus retrigger event occurs, players who have positions on the fourth and/or fifth columns are more likely to keep their positions for the additional free spins and potentially earn more awards.

In certain embodiments, accumulating positions on the bonus game display matrix enables players to win one or more progressive awards. In one embodiment, each position of the bonus game display matrix is associated with a separate progressive award. In other embodiments, each row of positions (or a particular group of rows of positions) of the bonus game display matrix is associated with a separate progressive award. In one embodiment, each position on one of the reels, such as the first reel, is associated with a progressive award. In one embodiment, a winning symbol combination whose first symbol starts in a particular position awards the progressive associated with that position. In other embodiments, each column of positions (or a particular group of column of positions) of the bonus game display matrix is associated with a separate progressive award. In one embodiment, different positions of the bonus game display matrix are associated different portions or percentages of a progressive award. In one embodiment, each payline is associated with a progressive award.

In other embodiments, the amount of the progressive award that a player wins is proportional to the player's primary game wager that earned that player eligibility for the progressive award (i.e., that earned the player the position on the bonus game display matrix). For example, if a player obtains a position on the bonus game display matrix based on a play of the game in which the player placed a primary game wager of five credits, and that position subsequently earns a progressive award, the player wins the entire progressive award. However, if a player obtains a position on the bonus game display matrix based on a play of the game in which the player placed a primary game wager of one credit, and that position subsequently earns a progressive award, the player earns only $1/5^{th}$ the progressive award.

In one embodiment, as the players play the primary games of their respective gaming devices, a portion of each wager placed is used to fund one or more progressive awards. In one such embodiment, as the amount of a player's primary game wager increases, that player's chance of obtaining positions on the bonus game display matrix increases. By wagering at a higher level, a player can accumulate more positions on the bonus game display matrix and, thus, has an increased chance of winning a progressive award.

In one embodiment, the controller enables players to each pay a predetermined or predefined additional fee per primary game wager to be eligible for a progressive awards in the multi-player bonus game.

It should be appreciated that the present disclosure can incorporate any suitable type of primary or base game, such as a slot game, a poker game, a keno game, or a bingo game. It should also be appreciated that, in various alternative embodiments, the multi-player bonus game may be any type of game employing any suitable theme, such as a board game, a ladder game, or a wheel game, etc. The multi-player bonus game may be displayed: (i) on a display device of an individual gaming machine; (ii) by a shared display; (iii) by each display device of a plurality of gaming devices; or (iv) any combination of these.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one display device;

at least one input device;

at least one processor; and at least one memory device which stores a plurality of instructions, which when executed by the at least one processor, cause the at least one processor to:

receive, via the at least one input device, a wager placed on a play of a primary game, for the play of the primary game:

randomly determine a primary game outcome, cause the at least one display device to display the randomly determined primary game outcome, determine any award associated with the randomly determined primary game outcome, and cause the at least one display device to display any determined award associated with the randomly determined primary game outcome, for each designated accumulation event occurring prior to a play of a secondary game, accumulate a quantity of secondary game elements for use in the play of the secondary game, wherein prior to any occurrence of any secondary game triggering event, a predetermined first secondary game element has a first predetermined average expected value in the play of the secondary game and prior to any occurrence of any secondary game triggering event, a predetermined second, different secondary game element has a second, different predetermined average expected value in the play of the secondary game, and cause the at least one display device to display an indication of any accumulated secondary game elements.

2. The gaming system of claim 1, wherein prior to any occurrence of any secondary game triggering event, each of the different secondary game elements has a different average expected value in the play of the secondary game.

3. The gaming system of claim 1, wherein the designated accumulation event includes a displayed event in the play of the primary game.

4. The gaming system of claim 1, wherein any determined award associated with the randomly determined primary game outcome is at least one of a quantity of monetary credits, a quantity of non-monetary credits, a quantity of promotional credits, and a quantity of player tracking points.

5. The gaming system of claim 1, which includes a housing, and a plurality of input devices supported by the housing, said plurality of input devices including an acceptor, and a cashout device, wherein when executed by the at least one processor, the plurality of instructions cause the at least one processor to operate with the plurality of input devices to: responsive to a physical item being received via the acceptor, establish a credit balance based, at least in part, on a monetary value associated with the received physical item, and responsive to a cashout input being received via the cashout device, cause an initiation of any payout associated with the credit balance.

6. A gaming system server comprising:

at least one processor; and at least one memory device which stores a plurality of instructions, which when executed by the at least one processor, cause the at least one processor to:

receive data associated with a placement of a wager on a play of a primary game, for the play of the primary game:

randomly determine a primary game outcome, communicate data which results in at least one display device displaying the randomly determined primary game outcome, determine any award associated with the randomly determined primary game outcome, and communicate data which results in the at least one display device displaying any determined award associated with the randomly determined primary game outcome, for each designated accumulation event occurring prior to a play of a secondary game, accumulate a quantity of secondary game elements for use in the play of the secondary game, wherein prior to any occurrence of any secondary game triggering event, a predetermined first secondary game element has a first predetermined average expected value in the play of the secondary game and prior to any occurrence of any secondary game triggering event, a predetermined second, different secondary game element has a second, different predetermined average expected value in the play of the secondary game, and communicate data which results in the at least one display device displaying an indication of any accumulated secondary game elements.

7. The gaming system server of claim 6, wherein prior to any occurrence of any secondary game triggering event, each of the different secondary game elements has a different average expected value in the play of the secondary game.

8. The gaming system server of claim 6, wherein the designated accumulation event includes a displayed event in the play of the primary game.

9. The gaming system server of claim 6, wherein any determined award associated with the randomly determined primary game outcome is at least one of a quantity of monetary credits, a quantity of non-monetary credits, a quantity of promotional credits, and a quantity of player tracking points.

10. The gaming system server of claim 6, wherein any determined award associated with the randomly determined primary game outcome causes an increase of a credit balance which is increasable via an acceptor of a physical item associated with a monetary value, and decreasable via a cashout device configured to receive an input to cause an initiation of a payout associated with the credit balance.

11. A method of operating a gaming system, said method comprising:

receiving a wager placed on a play of a primary game, for the play of the primary game:

randomly determining, by at least one processor, a primary game outcome, displaying, by at least one display device, the randomly determined primary game outcome, determining, by the at least one processor, any award associated with the randomly determined primary game outcome, and displaying, by the at least one display device, any determined award associated with the randomly determined primary game outcome, for each designated accumulation event occurring prior to a play of a secondary game, accumulating, by the at least one processor, a quantity of secondary game elements for use in the play of the secondary game, wherein prior to any occurrence of any secondary game triggering event, a predetermined first secondary game element has a first predetermined average expected value in the play of the secondary game and prior to any occurrence of any secondary game triggering event, a predetermined second, different secondary game element has a second, different predetermined average expected value in the play of the secondary game, and displaying, by the at least one display device, an indication of any accumulated secondary game elements.

12. The method of claim 11, wherein prior to any occurrence of any secondary game triggering event, each of the different secondary game elements has a different average expected value in the play of the secondary game.

13. The method of claim 11, wherein the designated accumulation event includes a displayed event in the play of the primary game.

14. The method of claim 11, wherein any determined award associated with the randomly determined primary game outcome is at least one of a quantity of monetary credits, a quantity of non-monetary credits, a quantity of promotional credits, and a quantity of player tracking points.

15. The method of claim 11, wherein any determined award associated with the randomly determined primary game outcome causes an increase of a credit balance which is increasable via an acceptor of a physical item associated with a monetary value, and decreasable via a cashout device configured to receive an input to cause an initiation of a payout associated with the credit balance.

16. The method of claim 11, which is provided through a data network.

17. The method of claim 16, wherein the data network is an internet.

18. A gaming system comprising:

at least one display device;

at least one input device;

at least one processor; and at least one memory device which stores a plurality of instructions, which when executed by the at least one processor, cause the at least one processor to:

receive, via the at least one input device, a wager placed on a play of a primary game, for the play of the primary game:

randomly determine a primary game outcome, cause the at least one display device to display the randomly determined primary game outcome, determine any award associated with the randomly determined primary game outcome, and cause the at least one display device to display any determined award associated with the randomly determined primary game outcome, for each occurrence of a designated accumulation event: accumulate a quantity of secondary game elements for use in a secondary game, wherein prior to any occurrence of any secondary game triggering event, a first secondary game element is associated with a first average expected value and a second, different secondary game element is associated with a second, different average expected value, cause the at least one display device to display an indication of any accumulated secondary game elements, and responsive to a secondary game triggering event occurring and at least one secondary game element being accumulated for use in the secondary game, determine an award based on a comparison of a plurality of displayed secondary game symbols of a secondary game outcome and said accumulated secondary game elements.

19. The gaming system of claim 18, wherein the average expected value of the first secondary game element is based on a first symbol display position of a secondary game symbol display position matrix and the average expected value of the second secondary game element is based on a second, different symbol display position of the secondary game symbol display position matrix.

20. A gaming system server comprising:

at least one processor; and at least one memory device which stores a plurality of instructions, which when executed by the at least one processor, cause the at least one processor to:

receive data associated with a placement of a wager on a play of a primary game, for the play of the primary game:

randomly determine a primary game outcome, communicate data which results in at least one display device displaying the randomly determined primary game outcome, determine any award associated with the randomly determined primary game outcome, and communicate data which results in the at least one display device displaying any determined award associated with the randomly determined primary game outcome, for each occurrence of a designated accumulation event, accumulate a quantity of secondary game elements for use in a secondary game, wherein prior to any occurrence of any secondary game triggering event, a first secondary game element is associated with a first average expected value and a second, different secondary game element is associated with a second, different average expected value, communicate data which results in the at least one display device displaying an indication of any accumulated secondary game elements, and responsive to a secondary game triggering event occurring and at least one secondary game element being accumulated for use in the secondary game, determine an award based on a comparison of a plurality of displayed secondary game symbols of a secondary game outcome and said accumulated secondary game elements.

21. The gaming system server of claim 20, wherein the average expected value of the first secondary game element is based on a first symbol display position of a secondary game symbol display position matrix and the average expected value of the second secondary game element is based on a second, different symbol display position of the secondary game symbol display position matrix.

22. A method of operating a gaming system, said method comprising:

receiving a wager placed on a play of a primary game, for the play of the primary game:

randomly determining, by at least one processor, a primary game outcome, displaying, by at least one display device, the randomly determined primary game outcome, determining, by the at least one processor, any award associated with the randomly determined primary game outcome, and displaying, by the at least one display device, any determined award associated with the randomly determined primary game outcome, for each occurrence of a designated accumulation event, accumulating, by the at least one processor, a quantity of secondary game elements for use in a secondary game, wherein prior to any occurrence of any secondary game triggering event, a first secondary game element is associated with a first average expected value and a second, different secondary game element is associated with a second, different average expected value, displaying, by the at least one display device, an indication of any accumulated secondary game elements, and responsive to a secondary game triggering event occurring and at least one secondary game element being accumulated for use in the secondary game, determining, by the at least one processor, an award based on a comparison of a plurality of displayed secondary game symbols of a secondary game outcome and said accumulated secondary game elements.

23. The method of claim 22, wherein the average expected value of the first secondary game element is based on a first symbol display position of a secondary game symbol display position matrix and the average expected value of the second secondary game element is based on a second, different symbol display position of the secondary game symbol display position matrix.

* * * * *